US008973847B2

(12) United States Patent
Iammatteo et al.

(10) Patent No.: US 8,973,847 B2
(45) Date of Patent: Mar. 10, 2015

(54) NON-AEROSOL LIQUID SPRAY DEVICE WITH CONTINUOUS SPRAY

(75) Inventors: Pasquale A. Iammatteo, Holmdel, NJ (US); Roman Bicej, Ocean Township, NJ (US)

(73) Assignee: Easy Spray LLC, Lake St. Louis, MO (US)

( * ) Notice: Subject to any disclaimer, the term of this patent is extended or adjusted under 35 U.S.C. 154(b) by 290 days.

(21) Appl. No.: 13/544,441

(22) Filed: Jul. 9, 2012

(65) Prior Publication Data

US 2014/0008452 A1 Jan. 9, 2014

(51) Int. Cl.
*B05B 17/04* (2006.01)

(52) U.S. Cl.
USPC ..... 239/11; 239/1; 239/321; 239/322; 239/323; 239/333; 239/357; 239/373; 239/579; 222/340

(58) Field of Classification Search
USPC ..... 239/1, 11, 321, 322, 323, 324, 329, 239/333, 349, 357, 373, 579; 222/340, 380, 222/381, 386
See application file for complete search history.

(56) References Cited

U.S. PATENT DOCUMENTS

| | | | | |
|---|---|---|---|---|
| 2,205,875 A | | 6/1940 | Coffey et al. | |
| 2,672,089 A | | 3/1954 | Johnson | |
| 2,743,847 A | | 5/1956 | Pollak | |
| 3,118,569 A | | 1/1964 | Liedberg et al. | |
| 3,191,807 A | | 6/1965 | Rodrigues, Jr. | |
| 3,640,470 A | * | 2/1972 | Susuki et al. | 239/333 |
| 3,761,022 A | * | 9/1973 | Kondo | 239/579 |
| 3,790,034 A | | 2/1974 | Horvath | |
| 3,898,866 A | | 8/1975 | Keyes et al. | |
| 4,067,499 A | | 1/1978 | Cohen | |
| 4,260,082 A | | 4/1981 | Rooney et al. | |
| 4,318,363 A | | 3/1982 | Moellman et al. | |
| 4,826,031 A | | 5/1989 | Rusgitti | |
| 5,102,052 A | | 4/1992 | Demarest et al. | |
| 5,141,137 A | | 8/1992 | Knodel | |
| 5,358,150 A | | 10/1994 | Scheuble et al. | |
| 5,370,317 A | | 12/1994 | Weston | |
| 5,547,131 A | * | 8/1996 | Brace | 239/324 |
| 5,556,001 A | | 9/1996 | Weissman et al. | |

(Continued)

FOREIGN PATENT DOCUMENTS

EP 1 449 595 A1 8/2004

OTHER PUBLICATIONS

Orge, R.F. et al., "Design of a Knapsack Sprayer for Local Fabrication," Agricultural Mechanization in Asia, Africa and Latin America, 2006, pp. 12-16, vol. 37, No. 2, Phil.

*Primary Examiner* — Steven J Ganey
(74) *Attorney, Agent, or Firm* — NSIP Law

(57) ABSTRACT

Aerosol-free spray devices are provided. According to some embodiments, a spray device includes a piston operable within a piston chamber and coupled to a vacuum plunger operable within a vacuum chamber. A charger is operable to move the piston and the vacuum plunger in a first direction to generate a vacuum in the piston chamber and the vacuum chamber, thereby drawing liquid into the piston chamber. The vacuum in the vacuum chamber acts on the piston to pressurize the liquid in the piston chamber. A spray actuator is operable to open a spray valve, thereby causing the vacuum in the vacuum chamber to force the plunger and the piston to move opposite the first direction, and forcing the liquid in the piston chamber through a spray nozzle as a liquid spray. According to other embodiments, a spring replaces the vacuum chamber and vacuum plunger.

22 Claims, 31 Drawing Sheets

(56) References Cited

U.S. PATENT DOCUMENTS

| | | | | |
|---|---|---|---|---|
| 5,570,840 | A | 11/1996 | Gettinger et al. | |
| 5,862,958 | A | 1/1999 | Edwards et al. | |
| 6,742,722 | B2 | 6/2004 | Hosoda et al. | |
| 7,219,848 | B2 | 5/2007 | Sweeton | |
| 7,243,860 | B2 | 7/2007 | Junkel et al. | |
| 7,431,574 | B2 | 10/2008 | Onishi | |
| 8,037,679 | B2 | 10/2011 | Fong et al. | |
| 8,177,101 | B1 | 5/2012 | Blake | |
| 2001/0023900 | A1 | 9/2001 | Stewart et al. | |
| 2006/0091238 | A1 | 5/2006 | Kutay et al. | |
| 2006/0191962 | A1 * | 8/2006 | Redl et al. | 222/386 |
| 2007/0175927 | A1 | 8/2007 | Ozanne et al. | |

* cited by examiner

NON-AEROSOL LIQUID SPRAY DEVICE WITH CONTINUOUS SPRAY

BACKGROUND

Many known continuous-spray devices for spraying liquids use aerosol propellants. Such devices are considered by many to be harmful to the environment, and are targeted for regulation/elimination by federal and state agencies. Additionally, many known finger-sprayers and trigger sprayers can be difficult or tedious to operate, and can only deliver an intermittent liquid spray upon a single actuation of the device.

In view of the above considerations, it is desirable to provide liquid spray devices that are capable of providing a continuous spray of liquid and do not use aerosol propellants. It is also desirable to provide liquid spray devices that are easier to operate than known trigger-type or finger-actuated sprayers. It is further desirable to provide spray devices that are cost-effective to manufacture, refillable and recyclable. Additional objectives and desires can be understood from the following description and drawings.

SUMMARY OF EMBODIMENTS OF THE INVENTION

The disclosure concerns improved, non-aerosol liquid spray devices that are capable of providing a continuous spray of liquids. The spray devices disclosed herein are environmentally friendly, easy to operate and inexpensive to manufacture in comparison to traditional devices that provide continuous liquid spray.

According to an embodiment, a liquid spray device comprises: a body defining a reservoir for holding content (e.g., liquid); a piston chamber in selective communication with the reservoir; a piston slidably positioned in the piston chamber; a vacuum chamber; a vacuum plunger slidably positioned in the vacuum chamber and operably connected to the piston; a charger operatively connected to the piston and the plunger and operable to displace the piston and the plunger to create a vacuum in the vacuum chamber and impose a force on the vacuum plunger and the piston, thereby pressurizing a quantity of the content in the piston chamber; and a spray nozzle in selective communication with the piston chamber. A first valve is configured to control flow of the content from the reservoir into the piston chamber. A second valve is configured to control flow of the quantity of the content in the piston chamber out of the piston chamber to the nozzle. A spray actuator is operatively connected to the second valve and is operable to generate a spray of the content from the nozzle by opening the second valve.

According to another embodiment, a liquid spray device comprises: a body defining a reservoir for holding content (e.g., liquid); a piston chamber in selective communication with the reservoir; a piston slidably positioned in the piston chamber, the piston comprising an interior passage in communication with the piston chamber and in selective communication with the reservoir; a power spring; a charger operatively connected to the piston assembly and the power spring and operable to displace the piston and the power spring to cause the power spring to impose a force on the piston, thereby pressurizing a quantity of the content in the piston chamber; and a spray nozzle in selective communication with the piston chamber. A first valve is formed in the piston and is configured to control flow of the content from the reservoir into the interior passage. A second valve is configured to control flow of the quantity of the content in the piston chamber out of the piston chamber to the nozzle. A spray actuator is operatively connected to the second valve and is operable to generate a spray of the content from the nozzle by opening the second valve.

According to another embodiment, a liquid spray device comprises: a body defining a reservoir for holding content (e.g., liquid); a drive assembly including a base member with radially-projecting teeth, a piston mount, and a spring seat; a piston secured in the piston mount and slidably positioned in the piston chamber; a power spring secured in the spring seat; a substantially hollow, cylindrical charger operatively connected to the piston and the power spring; and a spray nozzle in selective communication with the piston chamber. The charger includes internal threads configured to engage the radially-projecting teeth and is operable by rotation of the charger with respect to the body to cause the base member, the piston and the plunger to rotate, thereby displacing the piston and the power spring to cause the power spring to impose a force on the piston, and pressurizing a quantity of the content in the piston chamber. A first valve is configured to control flow of the content from the reservoir into the piston chamber. A second valve is configured to control flow of the quantity of the content in the piston chamber out of the piston chamber to the nozzle. A spray actuator is operatively connected to the second valve and is operable to generate a spray of the content from the nozzle by opening the second valve.

According to another embodiment, a method of spraying content (e.g., liquid) from a device comprises: actuating a charger of the device to pressurize a quantity of content in a piston chamber of the device; and actuating a spray actuator of the device to release a spray of the content from the device. According to the method, the device comprises: a body defining a reservoir for holding the content, the reservoir being in selective communication with the piston chamber; a piston slidably positioned in the piston chamber; a first valve configured to control flow of the content from the reservoir into the piston chamber; a vacuum chamber; a vacuum plunger slidably positioned in the vacuum chamber and operably connected to the piston; a spray nozzle in selective communication with the piston chamber; and a second valve configured to control flow of the quantity of the content in the piston chamber out of the piston chamber to the nozzle. The charger is operatively connected to the piston and the plunger, and is operable to pressurize the quantity of the content in the piston chamber by displacing the piston and the plunger to create a vacuum in the vacuum chamber and impose a force on the vacuum plunger and the piston. The spray actuator is operatively connected to the second valve and is operable to generate the spray of the content from the nozzle by opening the second valve.

Additional features and advantages of the inventions will be apparent from the following detailed description and accompanying drawings.

BRIEF DESCRIPTION OF THE DRAWINGS DEPICTING EMBODIMENTS OF THE INVENTION

DETAILED DESCRIPTION OF EMBODIMENTS OF THE INVENTION

The following description discloses embodiments of various spray devices for spraying liquids. Such spray devices are suitable for providing a continuous spray of a liquid, such as a household cleaner, water, hair spray, etc.

In the following description and associated drawings, reference numbers and characters repeated between the various embodiments indicate similar components and features. Throughout the description, reference is made to various directions, such as "bottom", "top", "up", "upward", "upwardly", "down", "downward", "downwardly", "clockwise" and "counterclockwise." These terms are used to reference directions relative to spray devices positioned in a typical upright position for use. However, it should be understood that such directional terms are relative terms used to facilitate understanding of the devices as shown in the appended drawings, and are not intended to be limiting. Further, the use of the words "is" and "includes" are meant to be non-limiting. Thus, when the function or operation of a device or a component of a device is described using the word "is" it should be understood that the described function or operation is non-limiting, and there may be other, equivalent functions or operations that fall within the scope of the invention. Alternatively, the described function or operation may be optional. Relatedly, when the word "includes" is used to describe the inclusion of a component it should be understood that the specific component described is non-limiting, and there may be other equivalent components that fall within the scope of the invention. Alternatively, the inclusion of the component may be optional. In interpreting the words "is" and "includes" it may be appropriate to interpret these words as meaning "may", or "may be", or "may include", depending on the context of the discussion. Yet further, for ease of understanding the discussion that follows describes the exemplary devices as using a liquid as exemplary content. However, it should be noted that the exemplary devices exist and operate without liquid content (e.g., when the content is air, a vacuum or pressurized air).

Additionally, the following description references various connections and structural interactions between various components and assemblies. In describing such connections and interactions, terms such as "attached", "connected", "mounted" and "fitted" are used. It should be understood that such terms are intended to describe exemplary structural connections and interactions, and are not intended to limit the described components and assemblies to any particular method of assembly or manufacture.

Figure 1A:
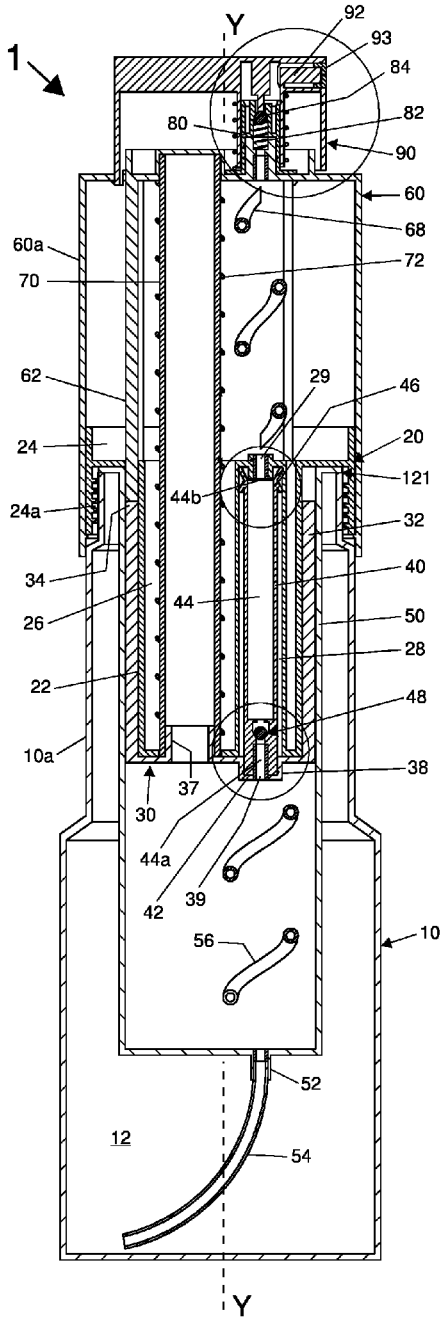
FIG. 1A is a cross-sectional view of a liquid spray device according to an embodiment of the invention, wherein the spray device is in an initial, uncharged, configuration.
Figure 1D:
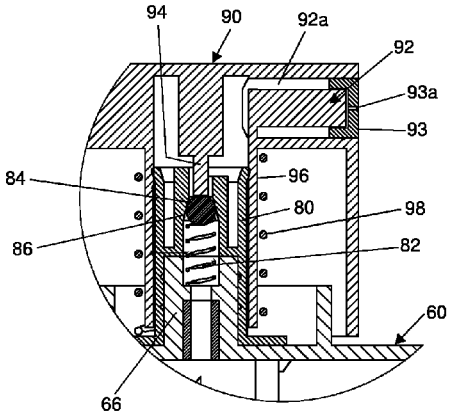
FIGS. 1B-1D are cut-away views showing components of the spray device of FIG. 1A.
Figure 1B:
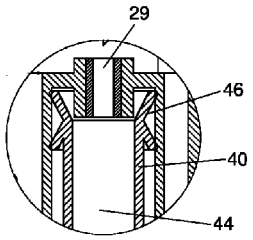
Figure 1C:
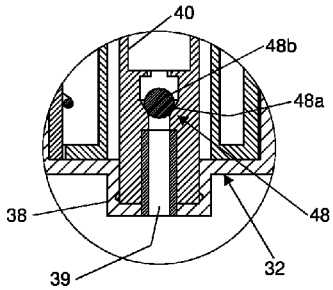

FIGS. 1A-1D shows a spray device 1 according to an embodiment of the invention. Referring to FIG. 1A, the spray device 1 includes a bottle body 10 for supporting and housing various components of the device 1, and defining an interior liquid reservoir 12 for containing a liquid that may be sprayed from the device 1. The device 1 further includes a charger 60 that is operable to place the device 1 in a charged configuration in which the device 1 is ready to spray liquid, and a spray actuator 90 that is operable to release liquid spray from the device 1. The bottle body 10, charger 60 and spray actuator 90 can each be constructed of a suitably rigid material such as plastic, metal or steel, to name a few examples. However a lightweight plastic material is preferred.

Figure 2C:
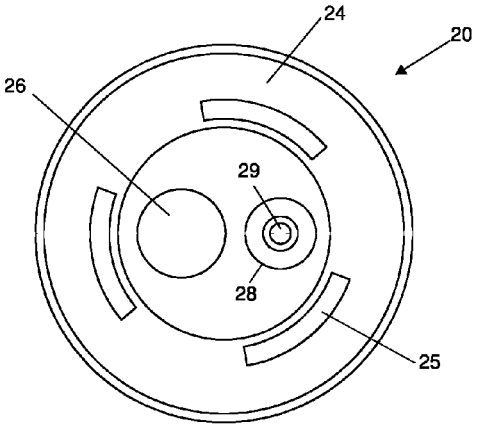
FIGS. 2A-2C are cross-sectional, perspective and top views of a piston cylinder of the spray device of FIG. 1A.
Figure 2B:
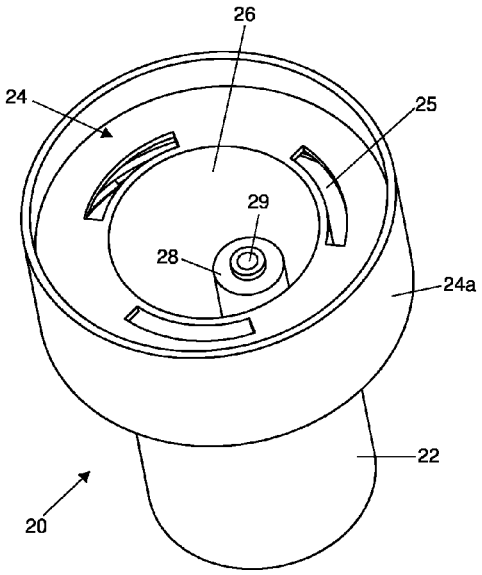
Figure 2A:
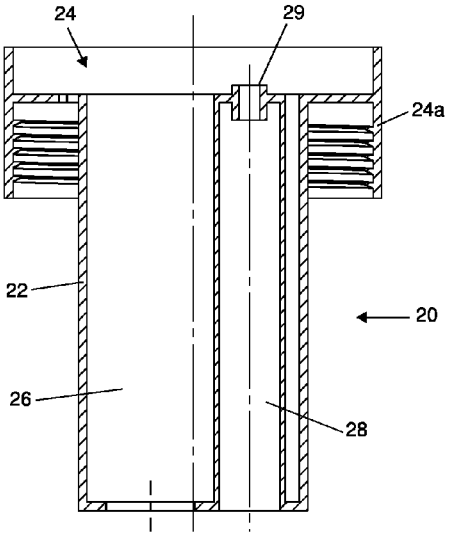

As shown in FIG. 1A, a piston cylinder 20 is fitted within an upper portion 10*a* of the bottle body 10. As shown in FIGS. 2A-2C, the piston cylinder 20 includes a substantially hollow, cylindrical cylinder body 22 and a cylinder head 24. The cylinder head 24 can be secured to the bottle body 10 by an interference/press fit or, optionally, a threaded engagement (not shown) between a flange 24*a* of the cylinder head 24 and an outer surface of the bottle body 10, for example. Charger guide slots 25 are provided in the top face of the cylinder head 24 for guiding reciprocating movement of the charger 60, as will be described later in more detail. The cylinder body 22 is divided into a spring chamber 26 and a piston chamber 28 having an exit port 29, with the chambers 26, 28 being located laterally adjacent to each other. The piston cylinder 20 can be constructed of a suitably rigid material such as plastic, metal or steel, to name a few examples. However a lightweight plastic material is preferred.

Figure 3C:
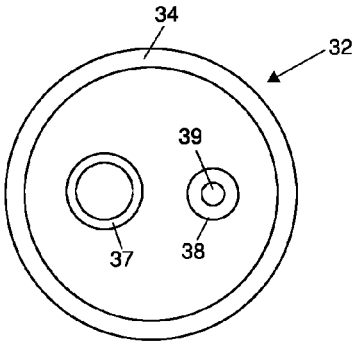
FIGS. 3A-3C are cross-sectional, perspective and top views of a piston base of the spray device of FIG. 1A.
Figure 3A:
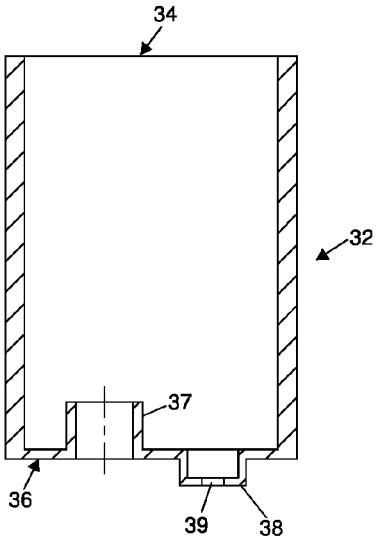
Figure 3B:
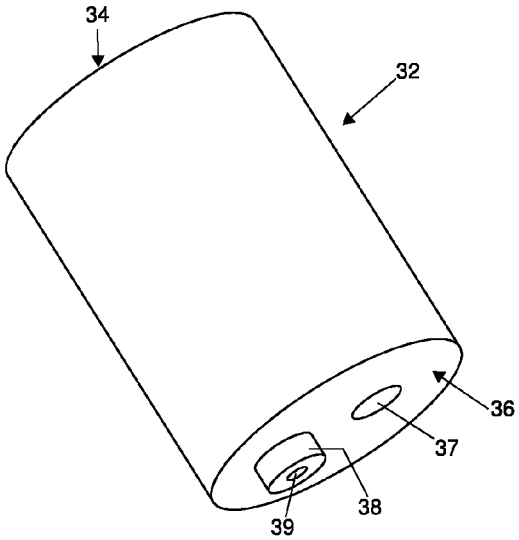
Figure 4C:
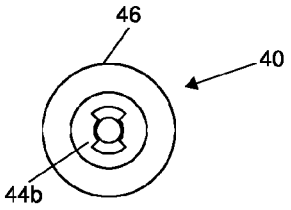
FIGS. 4A-4C are cross-sectional, perspective and top views of a piston of the spray device of FIG. 1A.
Figure 4B:
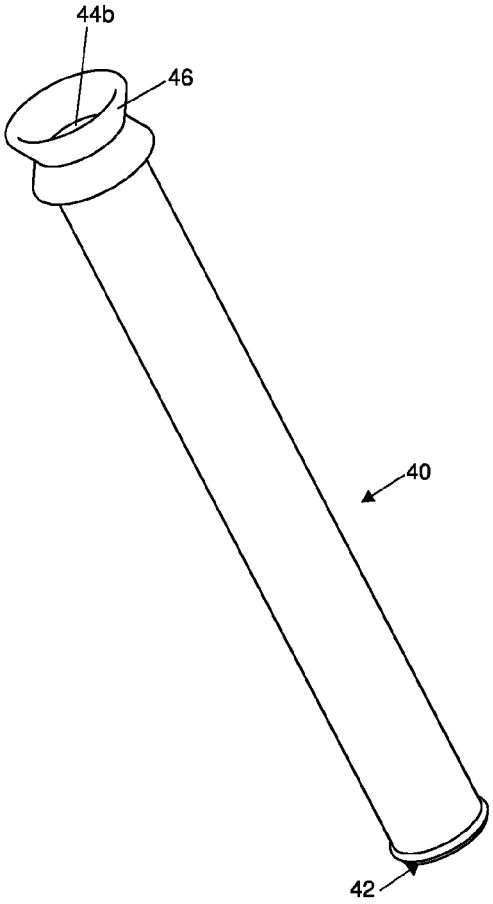
Figure 4A:
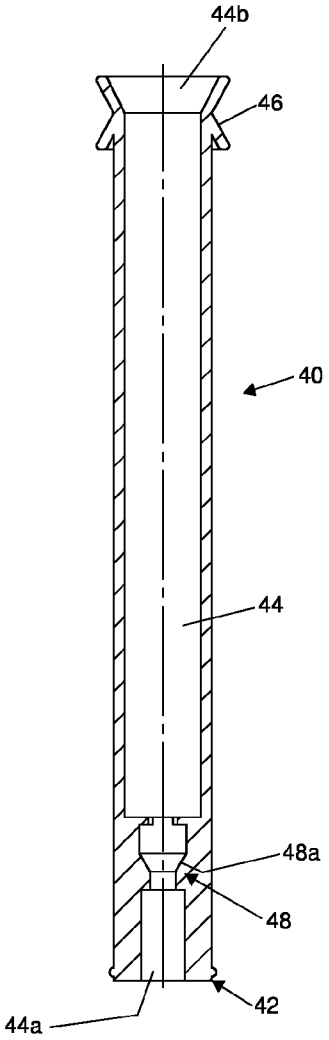
Figure 5C:
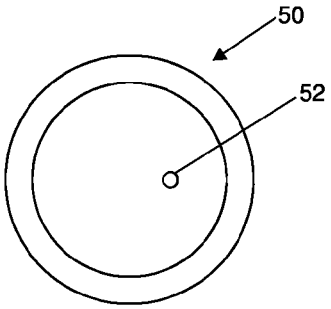
FIGS. 5A-5C are cross-sectional, perspective and top views of a piston base housing of the spray device of FIG. 1A.
Figure 5B:
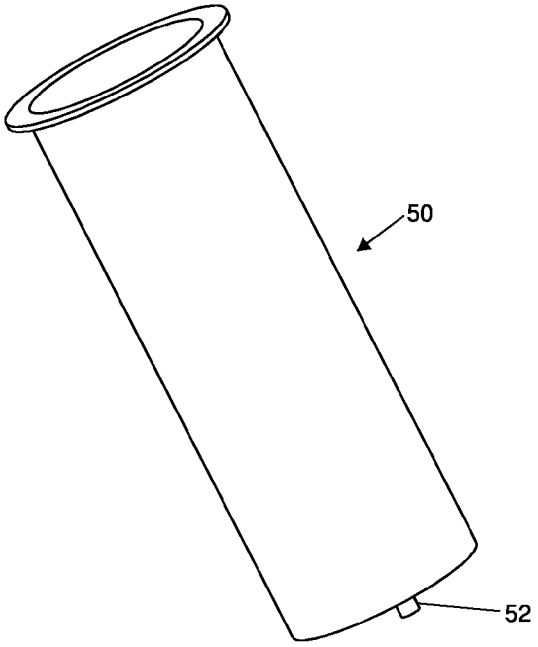
Figure 5A:
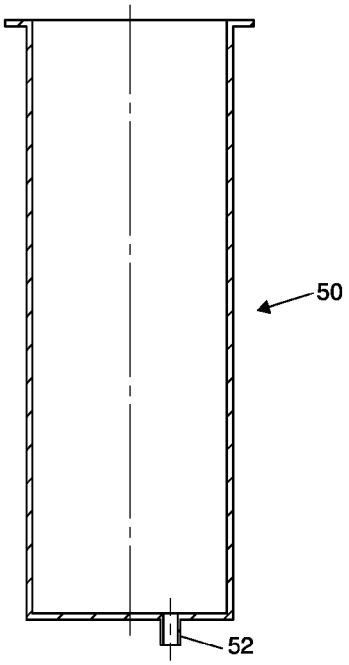
Figure 6D:
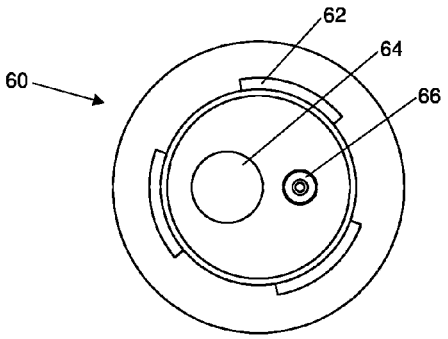
FIGS. 6A-6D are cross-sectional, bottom perspective, top perspective and top views of a charger of the spray device of FIG. 1A.
Figure 6C:
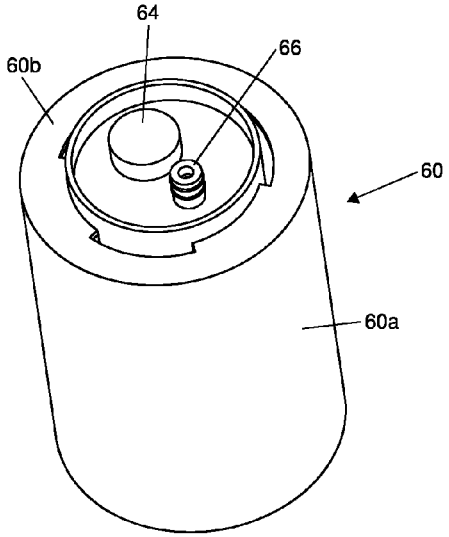
Figure 6A:
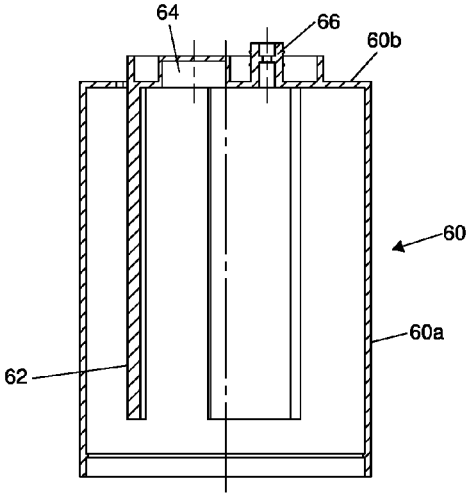
Figure 6B:
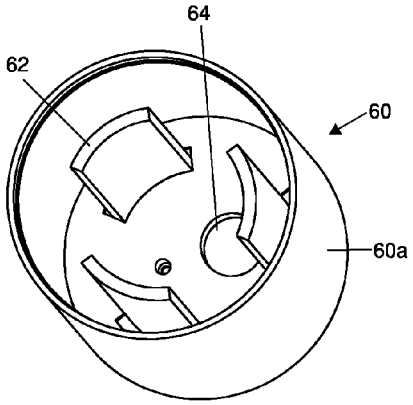
Figure 7D:
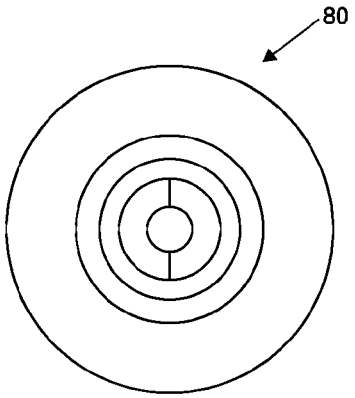
FIGS. 7A-7D are cross-sectional, perspective, side and top views of a valve cap of the spray device of FIG. 1A.
Figure 7C:
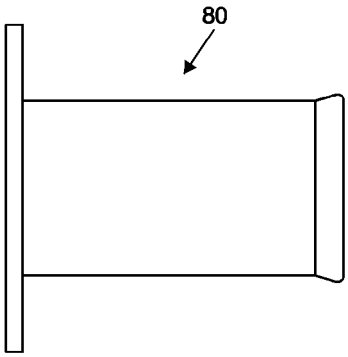
Figure 7A:
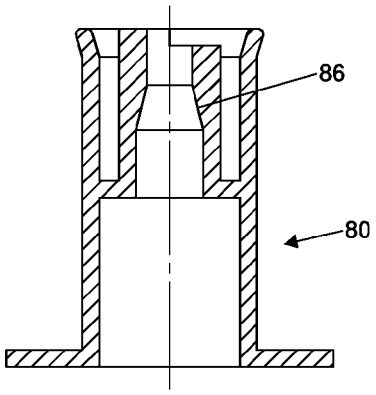
Figure 7B:
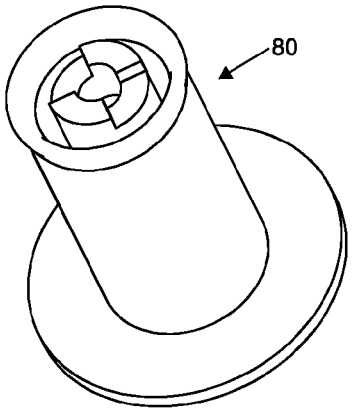
Figure 8D:
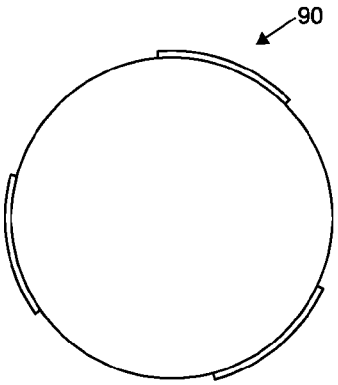
FIGS. 8A-8D are cross-sectional, perspective, side and top views of a spray actuator of the spray device of FIG. 1A.
Figure 8C:
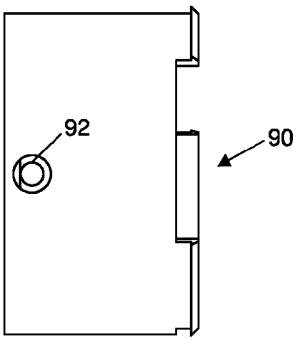
Figure 8A:
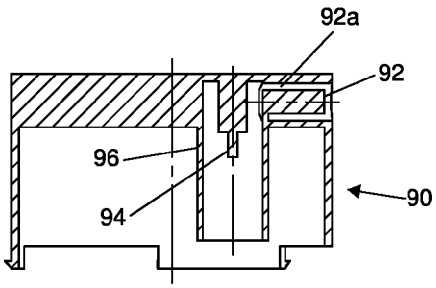
Figure 8B:
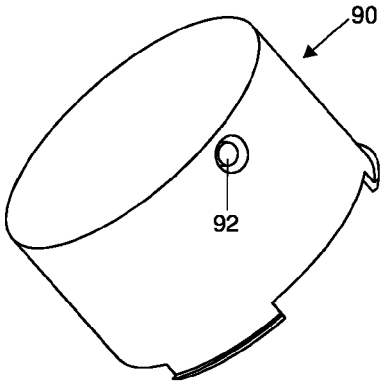

Turning back to FIG. 1A, a piston assembly 30 is mounted in the bottle body 10 and interfaces with the piston cylinder 20. The piston assembly 30 includes a piston base 32 fitted over the cylinder body 22 of the piston cylinder 20, and a piston 40 that is positioned to reciprocate along the Y axis of the device 1 within the piston chamber 28 in order to draw liquid into the piston chamber 28 and generate liquid spray. The piston assembly 30 is preferably constructed of a lightweight plastic material, however, other materials, for example, metal or steel, can be used. Referring to FIGS. 3A-3C, the piston base 32 is a substantially hollow, cylindrical-shaped member having an open top end 34 and a bottom end 36. The bottom end 36 includes a spring rod mount 37 and a piston seat 38 with a port 39. As shown in FIG. 1A, a bottom end 42 of the piston 40 is secured in the piston seat 38. Referring to FIGS. 1A, 1B and 4A-4C, the piston 40 includes an interior liquid passage 44 beginning at an inlet opening 44*a* at the bottom end 42 of the piston 40 and terminating at an exit opening 44*b* at a piston head 46 at a top end of the piston 40. The inlet opening 44*a* is aligned with the port 39 of the piston base 32. A piston valve 48 (shown in FIGS. 1C and 4A) is formed at the bottom end 42 of the piston 40, and can include a valve seat 48*a* and a ball 48*b* that can be moved into and out of engagement with the valve seat 48*a* for controlling the flow of liquid into the liquid passage 44 and the piston chamber 28. As illustrated in FIG. 1A, the piston valve 48 is biased in a closed position in which the ball 48*b* is seated within the valve seat 48*a*, to block liquid flow from the interior liquid passage 44 of the piston 40 back into the liquid reservoir 12.

A piston base housing 50, shown in FIGS. 1A and 5A-5C, is mounted in the bottle body 10 and is fitted around the piston base 32. The piston base 50 is a generally hollow, cylindrical body and includes a nipple 52 at its bottom end. The piston base housing 50 can be constructed of a lightweight plastic material, or another suitable material such as a metal or steel. A dip tube 54 (see FIG. 1A) is attached to the nipple 52 and extends into the liquid reservoir 12. A lower spiral tube 56 (partially shown in cross-section in FIG. 1A) is connected to the nipple 52 at the interior of the piston base housing 50, and extends to the port 39 of the piston base 32 and the liquid inlet opening 44*a* of the piston 40. Thus, when liquid is present in the reservoir 12, it can be delivered to the liquid passage 44 of the piston 40 through the dip tube 54 and the lower spiral tube 56.

Referring again to FIG. 1A, the charger 60 is reciprocatably attached to the bottle body 10 for displacing the piston assembly 30 to charge the device 1 for spraying liquid. The charger 60 can be a substantially hollow cylinder and can be fitted over the flange 24*a* of the piston cylinder 20 by an interference or press fit, for example. The charger 60 can be configured such that its side walls 60*a* slide over the top portion 10*a* of the bottle body 10 when the charger 60 is moved in reciprocating fashion along the Y axis of the device 1. As shown in FIGS. 6A-6D, the charger 60 includes interior guide legs 62 that are received in the charger guide slots 25 of the cylinder head 24. The configuration of the charger side walls 60*a* and interior legs 62 allows the charger 60 and cylinder 20/bottle body 10 to move along the Y axis with respect to each other (i.e., translational motion). The interior legs 62 engage the top end 34 of the piston base 32, allowing the charger 60 and piston base 32 to exert forces upon each other to reciprocate the piston base 32, piston 40 and charger 60 along the Y axis. Referring to FIGS. 6A-6D, the charger 60 further includes a spring rod seat 64 and a nipple 66 at its top end 60*b*.

An upper spiral tube 68 is connected to the exit port 29 of the piston chamber 28 and the nipple 66 of the charger 60. Accordingly, selective fluid communication is provided between the liquid reservoir 12, the dip tube 54, the lower spiral tube 56, the liquid passage 44, the piston chamber 28 and the upper spiral tube 68. By "selective fluid communication" it is meant that various components, paths and/or volumes can be selectively placed in and out of fluid communication with certain other components, paths and/or volumes to allow fluid to pass therebetween based on the operation of the device by a user.

Turning back to FIG. 1A, a spring rod 70 extends through the spring chamber 26 of the cylinder 20 and through the interior of the charger 60. The ends of the spring rod 70 are secured in the spring rod seat 64 of the charger 60 and the spring rod mount 37 of the piston base 32. A power spring 72 is positioned over the spring rod 70 and, when uncompressed, biases the charger 60 in an initial, extended position in which the charger 60 is maximally extended away from the cylinder 20 and the piston head 46 is at its uppermost position in the piston chamber 28.

Continuing, as shown in FIGS. 1A and 1D and FIGS. 7A-7D, a valve cap 80 is shown fitted over the nipple 66 of the charger 60. The valve cap 80, includes a ball valve arrangement including a valve spring 82, received in the nipple 66, that biases a ball 84 upwardly into a seated position within a valve seat 86 such that the ball valve arrangement 82, 84, 86 is in a closed configuration, to thereby block liquid flow out of the nipple 66.

The spray actuator 90 is attached to the charger 60. As illustrated in FIGS. 8A-8D, the spray actuator 90 has the form of a generally cylindrical cap and includes a spray nozzle 92, an actuator pin or rod 94, and a mounting post 96. Referring back to FIG. 1D, the mounting post 96 is fitted over the nipple 66 of the charger 60 to secure the spray actuator 90 to the charger such that the actuator pin 94 is aligned with and positioned to engage the ball 84 in the valve cap 80. A biasing spring 98 is positioned over the mounting post 96 and engages the spray actuator 90 to bias the spray actuator in an extended position in which the ball valve arrangement 82, 84, 86 is in the closed configuration, thereby preventing liquid spray from the nozzle 92.

An insert 93 can be fitted in the nozzle 92 to provide a desired liquid spray pattern/characteristic based on a shape and size of one or more openings 93*a* in the insert 93 and the spacing/fitment of the insert within the liquid pathway 92*a* of the nozzle 92.

An air duck bill 121 (see FIG. 1A) is in communication with the liquid reservoir 12 and allows air from the atmosphere to be suctioned into the liquid reservoir 12 while preventing liquid in the liquid reservoir 12 from being released to the atmosphere, and preventing the bottle body 10 from collapsing during operation of the device 1.

The operation of the device 1 will now be described with reference to FIGS. 1A and 9.

In FIG. 1A, the device 1 is in an initial, "uncharged" configuration in which it is not prepared to spray liquid from the liquid reservoir 12. In this position, the piston 40 is at its uppermost position of its stroke. In order to "charge" the device 1 (i.e., place the device 1 in a configuration in which it is prepared to spray liquid), the charger 60 is pressed downwardly with respect to the bottle body 10. As the charger 60 is pressed downwardly, the charger 60 urges the piston base 32 downwardly, thereby moving the piston 40 downwardly within the piston chamber 28 and compressing the power spring 72. As the piston 40 moves downwardly, it generates a vacuum force in the interior passage 44 and the piston chamber 28, thereby causing the ball 48*b* to be lifted from the valve seat 48*a* and enabling liquid to enter the interior passage 44 and the piston chamber 28 from the reservoir 12 to fill the void generated by the vacuum in the piston chamber 28 and interior passage 44. Thus, downward motion charges the device 1 by loading the passage 44 and the piston chamber 28 with liquid and pressurizing the liquid in the passage 44 and the piston chamber 28 with an upward force on the piston 40 generated by the power spring 72. The charger 60 can be depressed until the device 1 is placed in its fully charged configuration shown in FIG. 9. When the device 1 is in the fully charged configuration, the charger 60 is in its lowermost position and the piston 40 and power spring 72 are locked in their fully charged positions such that the piston head 46 is at the lowermost position of its stroke and the power spring 72 is fully compressed.

Figure 9:
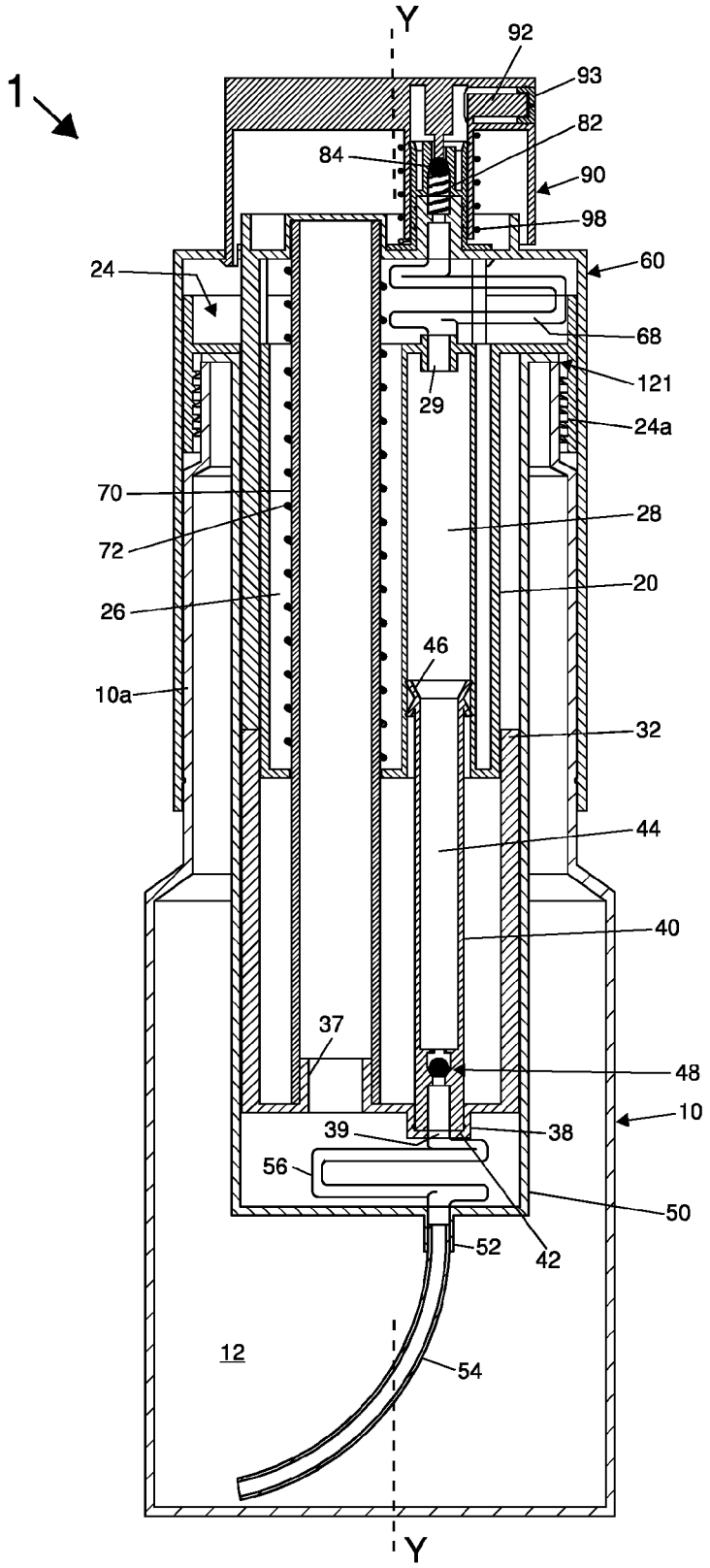
FIG. 9 shows the spray device of FIG. 1A in a fully charged configuration.

Once the device 1 is placed in the fully charged configuration illustrated in FIG. 9 and a user releases or stops depressing the charger 60, there is no longer a vacuum force in the piston chamber 28 and the interior passage 44 of the piston. The spring force pressurizing the quantity of liquid in the piston chamber 28 causes the ball 48*b* to engage the valve seat 48*a*, thereby placing the piston valve 48 back in the closed position and preventing any additional liquid from flowing into the interior passage 44 and the piston chamber 28. Because the piston valve 48 and valve arrangement 82, 84, 86 are closed, liquid cannot escape the piston chamber 28, the interior passage 44 and the upper spiral tube 68, thereby locking the device 1 in the fully charged configuration.

Once the device 1 is in the fully charged configuration, the user can depress the spray actuator 90 to move the spray actuator 90 downwardly with respect to the charger 60, thereby causing the actuator pin 94 to open the valve arrangement 82, 84, 86 by urging the ball 84 downwardly off of the valve seat 86, against the force of the valve spring 82. As a result, pressure in the piston chamber 28, the passage 44 and the upper spiral tube 68 is released, and the power spring 72 forces the charger 60 upward with respect to the bottle body 10. The upward motion of the charger 60 enables the piston base 32 and piston 40 to move upward such that the piston 40 moves upward within the piston chamber 28. The upward movement of the piston 40 forces liquid to flow out of the piston chamber 28 and the interior passage 44, and then through the nozzle 92 and insert 93 as a liquid spray. The liquid spray produced by the device 1 remains continuous until the user stops depressing the spray actuator 90 or a maximum possible amount of the liquid in the piston chamber 28, the passage 44 and the upper spiral tube 68 has been sprayed out of the nozzle 92. Once the user stops depressing the spray actuator 90, the valve arrangement 82, 84, 86 returns to its closed position, thereby preventing further liquid spray from the device 1. If a maximum possible amount of the liquid in the piston chamber 28, the passage 44 and the upper spiral tube 68 is sprayed out of the nozzle 92, the device 1 is returned to its initial configuration shown in FIG. 1A by the power spring 72.

It is noted that, when charging the device 1, a user can stop depressing the charger 60 before the device 1 reaches the fully charged configuration shown in FIG. 9, thereby causing the piston valve 48 to close and locking the device 1 in a partially charged configuration with the piston assembly 30 in a partially charged position and power spring 72 partially compressed. Once the user stops pressing the charger 60 at any position between its initial position of FIG. 1A and its fully charged position of FIG. 9, the piston assembly 30/piston 40 becomes locked in a partially charged position and the spray actuator 90 can be depressed to continuously spray liquid from the device 1.

Figure 10A:
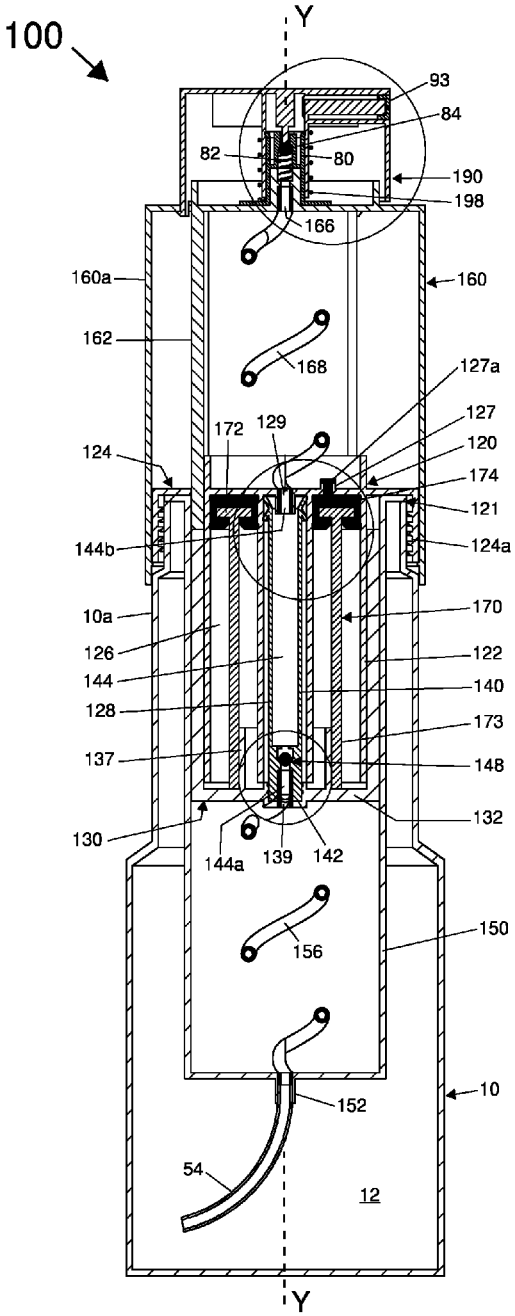
FIG. 10A is a cross-sectional view of a liquid spray device in an initial, uncharged, configuration according to another embodiment of the invention.

FIGS. 10A-10D show a spray device 100 according to another embodiment of the invention that includes a twin cylinder 120. As illustrated in FIG. 10A, the device 100 includes a bottle body 10 defining an interior liquid reservoir 12 containing a liquid to be sprayed from the device 100. The device 100 further includes a charger 160 that is operable to place the device 100 in a charged configuration in which the device 100 is ready to spray liquid, and a spray actuator 190 that is operable to release liquid spray from the device 100. The components of the device 100 can generally be constructed of the same materials described in the previous embodiment.

Still referencing FIG. 10A, a twin cylinder 120 is fitted within an upper portion 10*a* of the bottle body 10. As shown in FIGS. 11A-11D, the twin cylinder 120 includes a substantially hollow, cylindrical cylinder body 122 and a cylinder head 124. The cylinder head 124 can be secured to the bottle body 10 by an interference/press fit or threaded engagement between a flange 124*a* of the cylinder head 124 and an outer surface of the bottle body 10, for example. Charger guide slots 125 are provided in the top face of the cylinder head 124 for guiding reciprocating movement of the charger 160, as will be described later in more detail. The cylinder body 122 is divided into a vacuum chamber 126 and a piston chamber 128. The piston chamber 128 extends vertically through the center of the cylinder body 122, and the vacuum chamber 126, having an annular cross-section, concentrically surrounds the piston chamber 128. Preferably, the volume of the vacuum chamber 126 is larger than the volume of the piston chamber 128. The vacuum chamber 126 includes a vacuum regenerator port 127 which, during operation of the device 100, is sealed by a vacuum regenerator cap 127*a* (FIGS. 10A and 10B). The piston chamber 128 includes an exit port 129 for moving liquid out of the piston chamber 128.

Figure 12C:
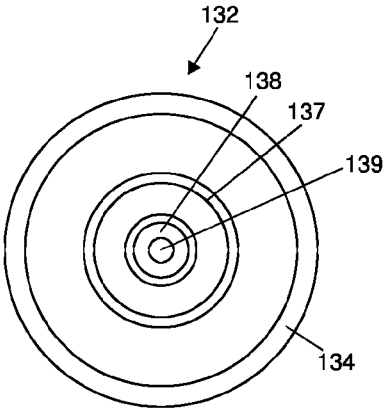
FIGS. 12A-12C are cross-sectional, perspective and top views of a piston and plunger base of the spray device of FIG. 10A.
Figure 12A:
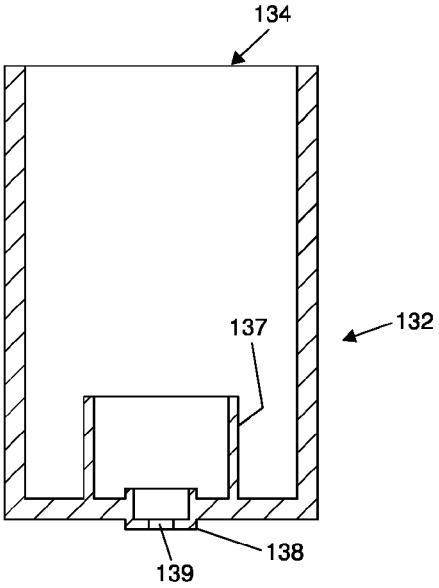
Figure 12B:
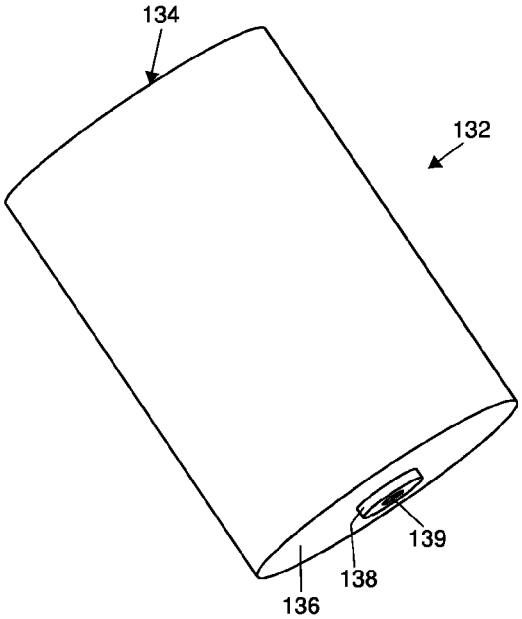
Figure 13C:
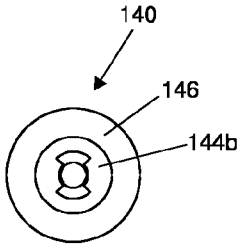
FIGS. 13A-13C are cross-sectional, perspective and top views of a piston of the spray device of FIG. 10A.
Figure 13A:
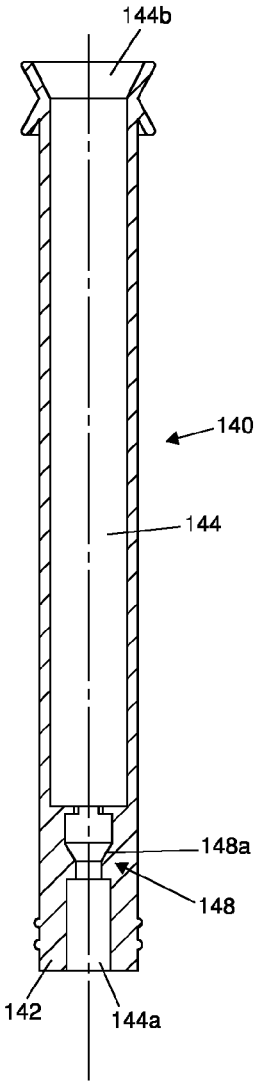
Figure 13B:
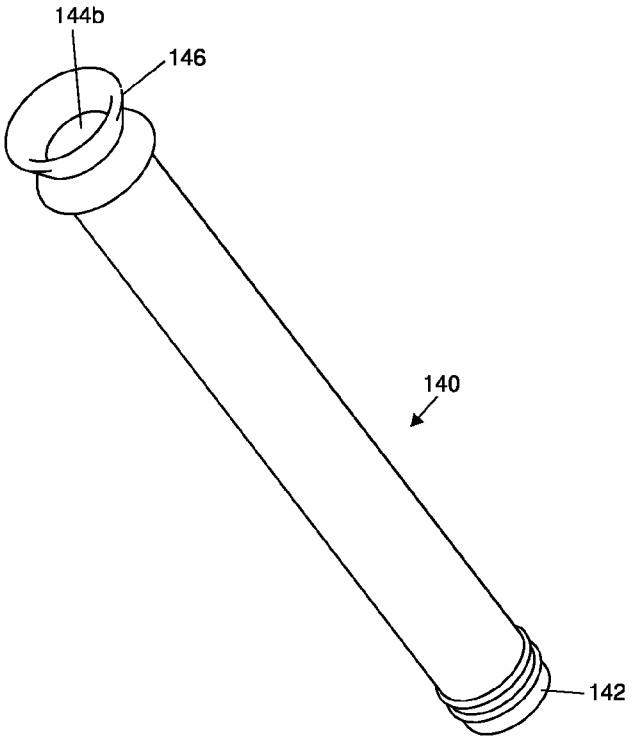
Figure 14C:
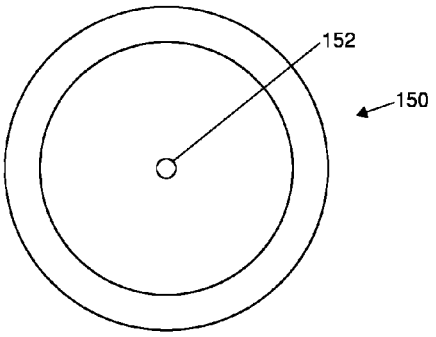
FIGS. 14A-14C are cross-sectional, perspective and top views of a piston and plunger base housing of the spray device of FIG. 10A.
Figure 14A:
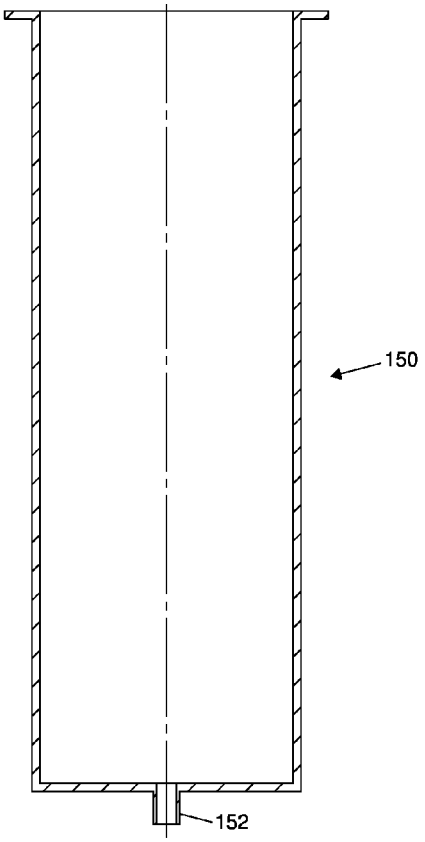
Figure 14B:
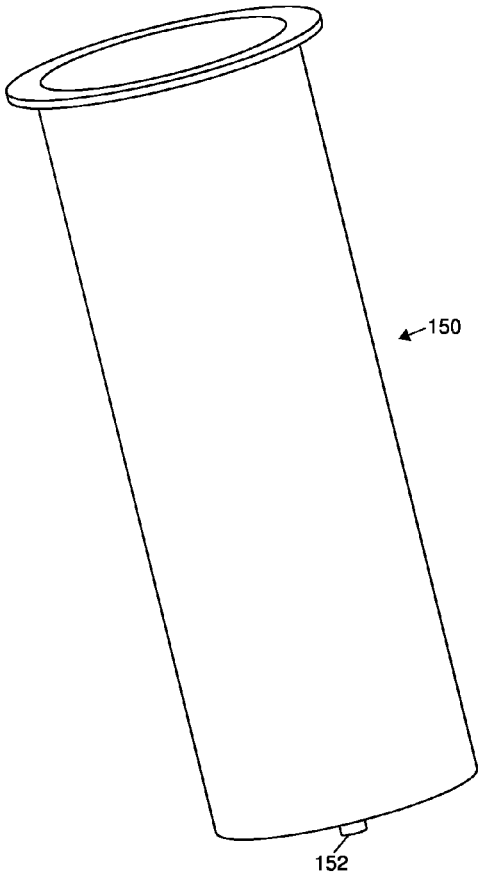
Figure 15D:
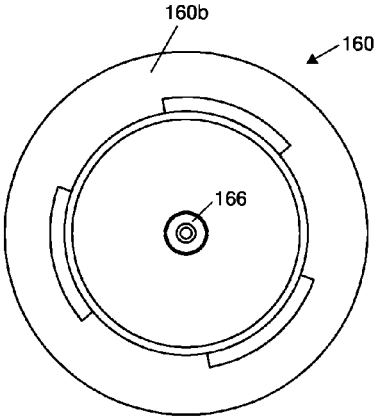
FIGS. 15A-15D are cross-sectional, bottom perspective, top perspective and top views of a charger of the spray device of FIG. 10A.
Figure 15C:
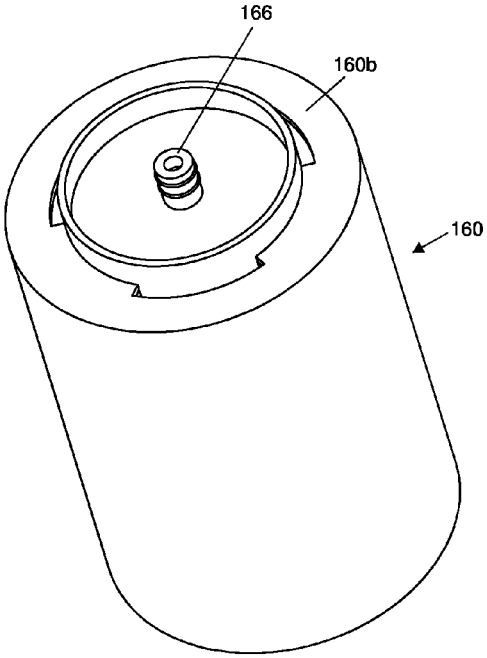
Figure 15A:
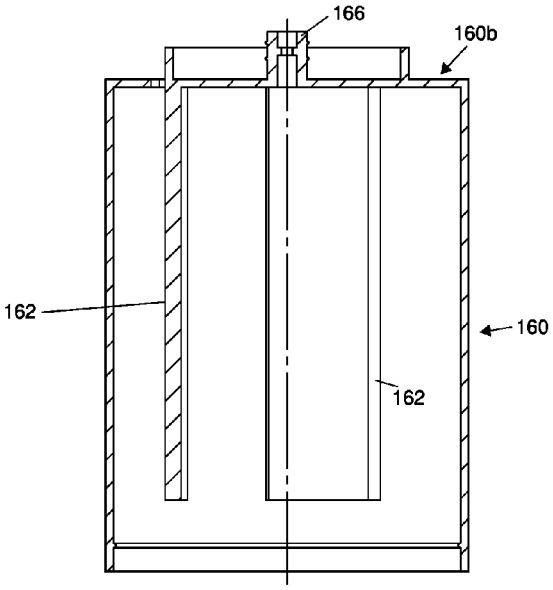
Figure 15B:
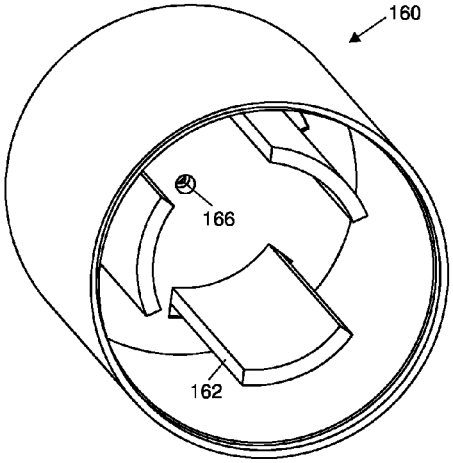

Turning back to FIG. 10A, a piston and plunger assembly 130 is mounted in the bottle body 10 and interfaces with the twin cylinder 120. The piston assembly 130 includes a piston and plunger base 132 fitted over the cylinder body 122 of the twin cylinder 120, a piston 140 that is positioned to slidably reciprocate along the Y axis of the device 100 within the piston chamber 128 in order to draw liquid into the piston chamber 128 and generate liquid spray, and a vacuum plunger 170 that is positioned to slidably reciprocate along the Y axis of the device 100 within the vacuum chamber 126 in order to create a vacuum in the vacuum chamber 126. The piston assembly 130 is preferably constructed of a lightweight plastic material, however, other materials such as a metal or steel can be used. Referring to FIGS. 12A-12C, the piston and plunger base 132 is a substantially hollow, cylindrical-shaped member having an open top end 134 and a bottom end 136. The bottom end 136 includes a plunger seat 137 and a piston seat 138 with a port 139. The plunger seat 137 is positioned concentrically around the piston seat 138. As shown in FIG. 10A, a bottom end 142 of the piston 140 is secured in the piston seat 138 and a bottom end 173 of the plunger 170 is secured on the plunger seat 137.

Referring to FIGS. 10A, 10B and 13A-13C, the piston 140 includes an interior liquid passage 144 beginning at an inlet opening 144*a* at the bottom end 142 of the piston 140 and terminating at an exit opening 144*b* at a piston head 146 at a top end of the piston 140. The inlet opening 144*a* is aligned with the port 139 of the piston base 132. A piston valve 148 (shown in FIG. 10C) is formed at the bottom end 142 of the piston 140, and can include a valve seat 148*a* and a ball 148*b* that can be moved into and out of engagement with the valve seat 148*a* for controlling the flow of liquid into the liquid passage 144 and the piston chamber 128. As illustrated in FIG. 10A, the piston valve 148 is biased in a closed position in which the ball 148*b* is seated within the valve seat 148*a*, blocking liquid flow into the interior liquid passage 144 of the piston 140.

Figure 16C:
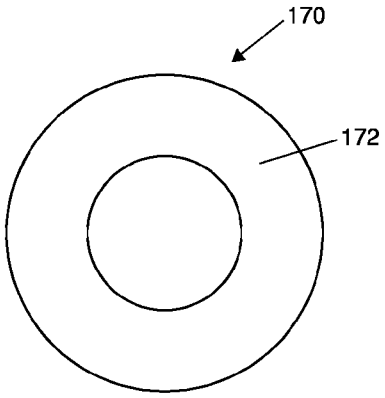
FIGS. 16A-16C are cross-sectional, perspective and top views of a plunger of the spray device of FIG. 10A.
Figure 16B:
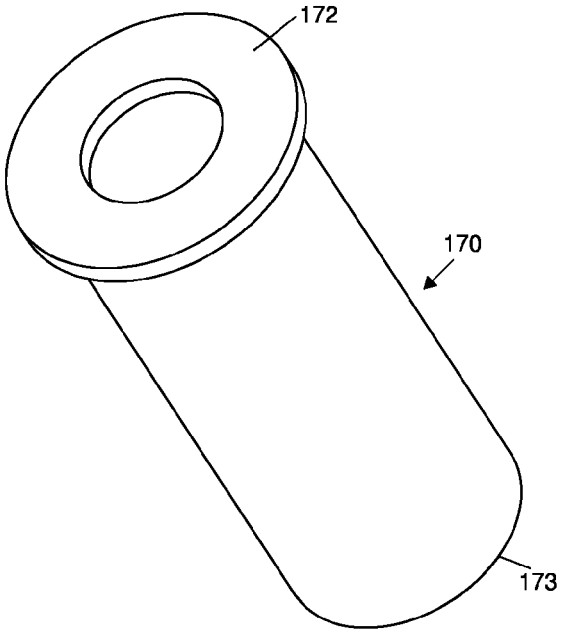
Figure 16A:
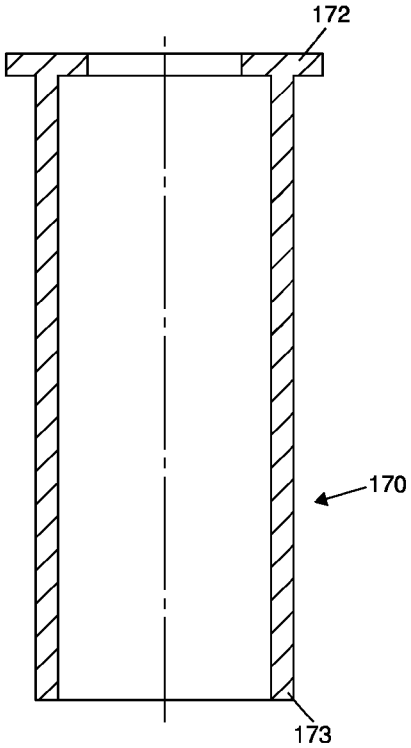
Figure 17E:
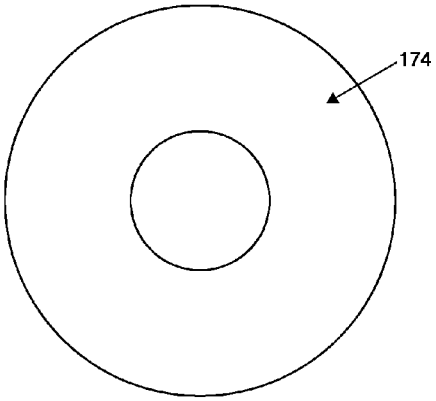
FIGS. 17A-17E are cross-sectional, bottom perspective, top perspective, side and top views of a vacuum seal of the spray device of FIG. 10A.
Figure 17D:
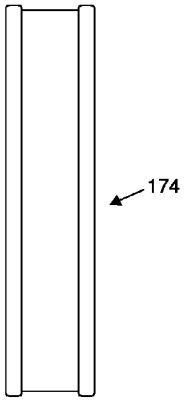
Figure 17A:
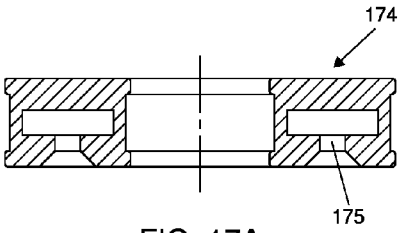
Figure 17C:
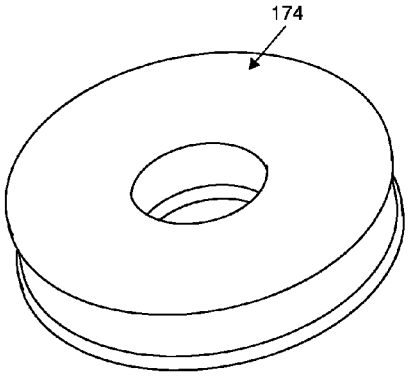
Figure 17B:
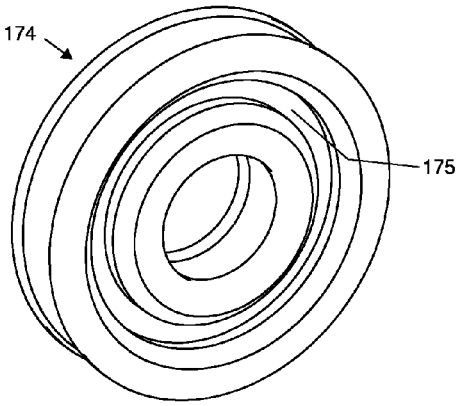
Figure 18D:
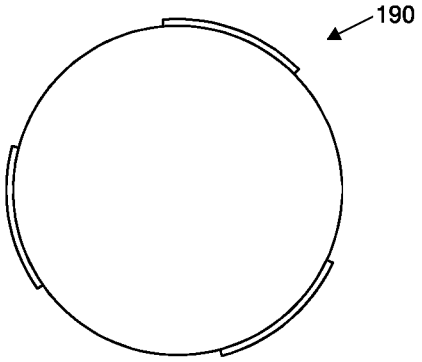
FIGS. 18A-18D are cross-sectional, side perspective, bottom perspective and top views of a spray actuator of the spray device of FIG. 10A.
Figure 18C:
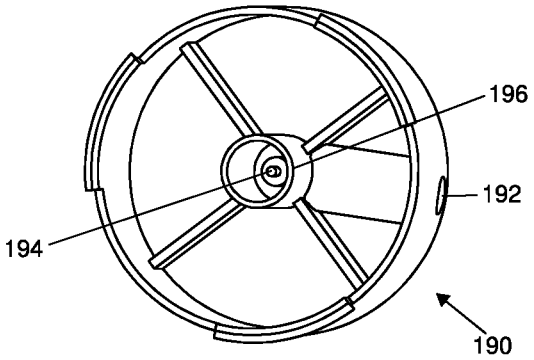
Figure 18A:
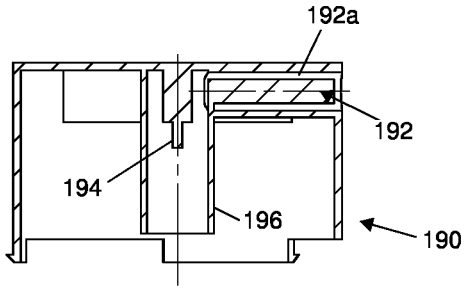
Figure 18B:
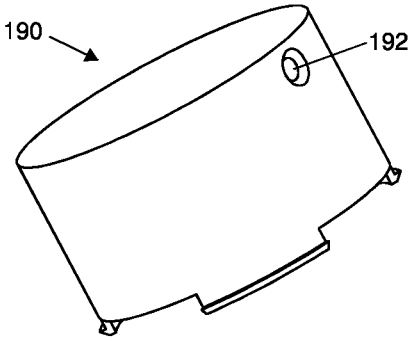

Turning to FIGS. 16A-16C, the vacuum plunger 170 is a generally hollow, cylindrical member having an annular plunger head 172 at its top end. Turning to back to FIGS. 10A and 10B, an annular seal 174 is attached to the plunger head 172 to provide a tight, interference fit with the interior walls of the vacuum chamber 126 such that a vacuum can be created and maintained in the vacuum chamber 126. The seal 174 can be constructed of an elastomeric material such as rubber or silicone, for example. As shown in FIGS. 17A-17E, the seal 174 includes a generally annular mounting slot 175 into which the plunger head 172 is tightly received.

A piston and plunger base housing 150, shown in FIGS. 10 and 14A-14C, is mounted in the bottle body 10 and is fitted around the piston and plunger base 132. The piston and plunger base 150 is a generally hollow, cylindrical body and includes a nipple 152 at its bottom end. A dip tube 54 is attached to the nipple 152 and extends into the liquid reservoir 12. A lower spiral tube 156 is connected to the nipple 152 at the interior of the piston base housing 150, and extends to the port 139 of the piston and plunger base 132 and the liquid inlet opening 144*a* of the piston 140. Thus, liquid in the reservoir 12 can be delivered to the liquid passage 144 of the piston 140 through the dip tube 54 and the lower spiral tube 156.

Referring again to FIG. 10A, in the assembled device 100, the charger 160 is reciprocatably attached to the bottle body 10 for displacing the piston assembly 130 to charge the device 100 for spraying liquid. The charger 160 can be a substantially hollow cylinder and can be fitted over the flange 124*a* of the piston cylinder 120 by an interference or press fit, for example. The charger 160 can be configured such that its side walls 160*a* slide over the top portion 10*a* of the bottle body 10 when the charger 160 is reciprocated along the Y axis of the device 100. As shown in FIGS. 15A-15D, the charger 160 includes interior guide legs 162 that are received in the charger guide slots 125 of the cylinder head 124 (see FIGS. 11B and 11D). The configuration of the charger side walls 160*a* and interior legs 162 allows the charger 160 and twin cylinder 120/bottle body 10 to move along the Y axis with respect to each other. The interior legs 162 engage the top end 134 of the piston and plunger base 132 (12A-12C), allowing the charger 160 and piston and plunger base 132 to exert forces upon each other to reciprocate the piston and plunger base 132, piston 140 and charger 160 along the Y axis. Still referring to FIGS. 15A-15D, the charger 160 further includes a nipple 166 at its top end 160*b*.

An upper spiral tube 168 (FIG. 10A) is connected to the exit port 129 of the piston chamber 128 and the nipple 166 of the charger 160. Accordingly, selective fluid communication is provided between the liquid reservoir 12, the dip tube 154, the lower spiral tube 156, the liquid passage 144, the piston chamber 128 and the upper spiral tube 168.

Figure 10D:
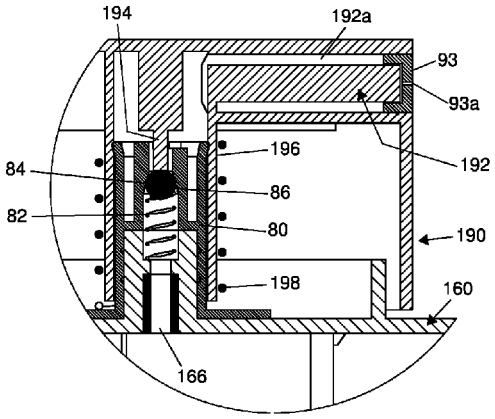
FIGS. 10B-10D are cut-away views showing components of the spray device of FIG. 10A.
Figure 10B:
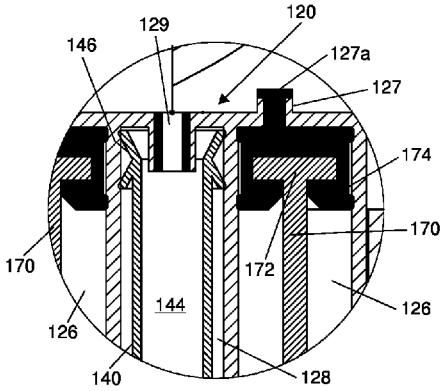
Figure 10C:
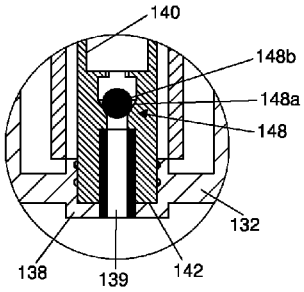
Figure 11D:
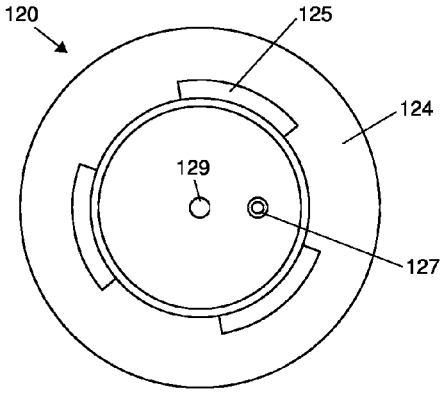
FIGS. 11A-11D are cross-sectional, bottom perspective, top perspective and top views of a twin cylinder of the spray device of FIG. 10A.
Figure 11C:
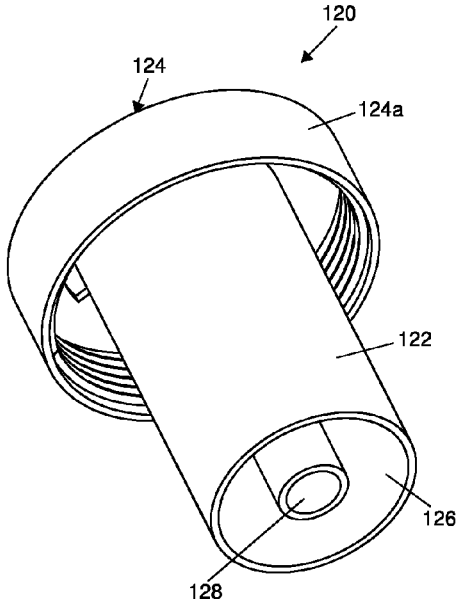
Figure 11A:
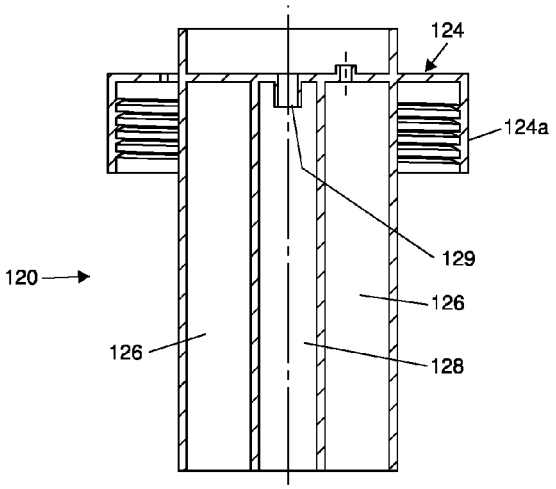
Figure 11B:
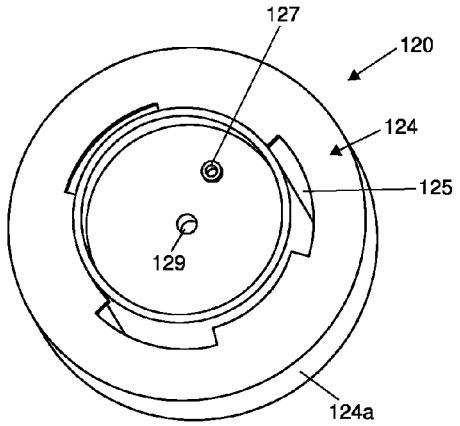

Continuing, as shown in FIGS. 10A and 10D, a valve cap 80 is fitted over the nipple 166 of the charger 160. The valve cap 80, includes a ball valve arrangement including a valve spring 82 that biases a ball 84 upwardly into a seated position within a valve seat 86 such that the ball valve arrangement 82, 84, 86 is in a closed configuration, thereby blocking liquid flow out of the nipple 166.

The spray actuator 190 is attached to the charger 160. As illustrated in FIGS. 18A-18D, the spray actuator 190 has the form of a generally cylindrical cap and includes a spray nozzle 192, an actuator pin or rod 194, and a mounting post 196. Referring back to FIG. 10D, the mounting post 196 is fitted over the nipple 166 of the charger 160 to secure the spray actuator 190 to the charger such that the actuator pin 194 is aligned with and positioned to engage the ball 84 in the valve cap 80. A biasing spring 198 is positioned over the mounting post 196 and engages the spray actuator 190 to bias the spray actuator in an extended position in which the ball valve arrangement 82, 84, 86 is in the closed configuration, thereby preventing liquid spray from the nozzle 192.

An insert 93 can be fitted in the nozzle 192 to provide a desired liquid spray pattern/characteristic based on a shape and size of one or more openings 93*a* in the insert 93, and the spacing/fitment of the insert within the liquid pathway 192*a* of the nozzle 192.

An air duck bill 121 (FIG. 10A) is in communication with the liquid reservoir 12 and allows air from the atmosphere to be suctioned into the liquid reservoir 12 while preventing liquid in the liquid reservoir 12 from being released to the atmosphere, and preventing the bottle body 10 from collapsing during operation of the device 100.

The operation of the device 100 will now be described with reference to FIGS. 10A and 19.

In FIG. 10A, the device 100 is in an initial, "uncharged" configuration in which it is not prepared to spray liquid from the liquid reservoir 12. In this position, the piston 140 and the plunger 170 are at the uppermost positions of their strokes. In order to "charge" the device 1 (i.e., place the device 100 in a position in which it is prepared to spray liquid), the charger 160 is pressed downwardly with respect to the bottle body 10. As the charger 160 is pressed downwardly, the charger 160 urges the piston and plunger base 132 downwardly, thereby simultaneously moving the piston 140 and the vacuum plunger 170 downwardly within the piston chamber 128 and the vacuum chamber 126, respectively. As the piston 140 moves downwardly, it generates a vacuum force in the interior passage 144 and the piston chamber 128, thereby causing the ball 148*b* to be lifted from the valve seat 148*a* and enabling liquid to enter the interior passage 144 and the piston chamber 128 from the reservoir 12 to fill the void created by the vacuum in the interior passage 144 and the piston chamber 128. As the plunger 170 moves downwardly, a vacuum is created in the vacuum chamber 126, resulting in an upward force acting on the plunger 170 and the piston 140. Thus, downward motion charges the device 100 by loading the passage 144 and piston chamber 128 with liquid and generating a vacuum force in the vacuum chamber 126 that causes the piston 140 to pressurize the liquid in the passage 144 and piston chamber 128. The charger 160 can be depressed until the device 100 is placed in its fully charged configuration shown in FIG. 19. When the device 100 is in the fully charged configuration, the charger 160 is in its lowermost position and the piston 140 and plunger 140 are locked in their fully charged positions such that the piston head 146 and plunger head 172 are at the lowermost positions of their strokes.

Figure 19:
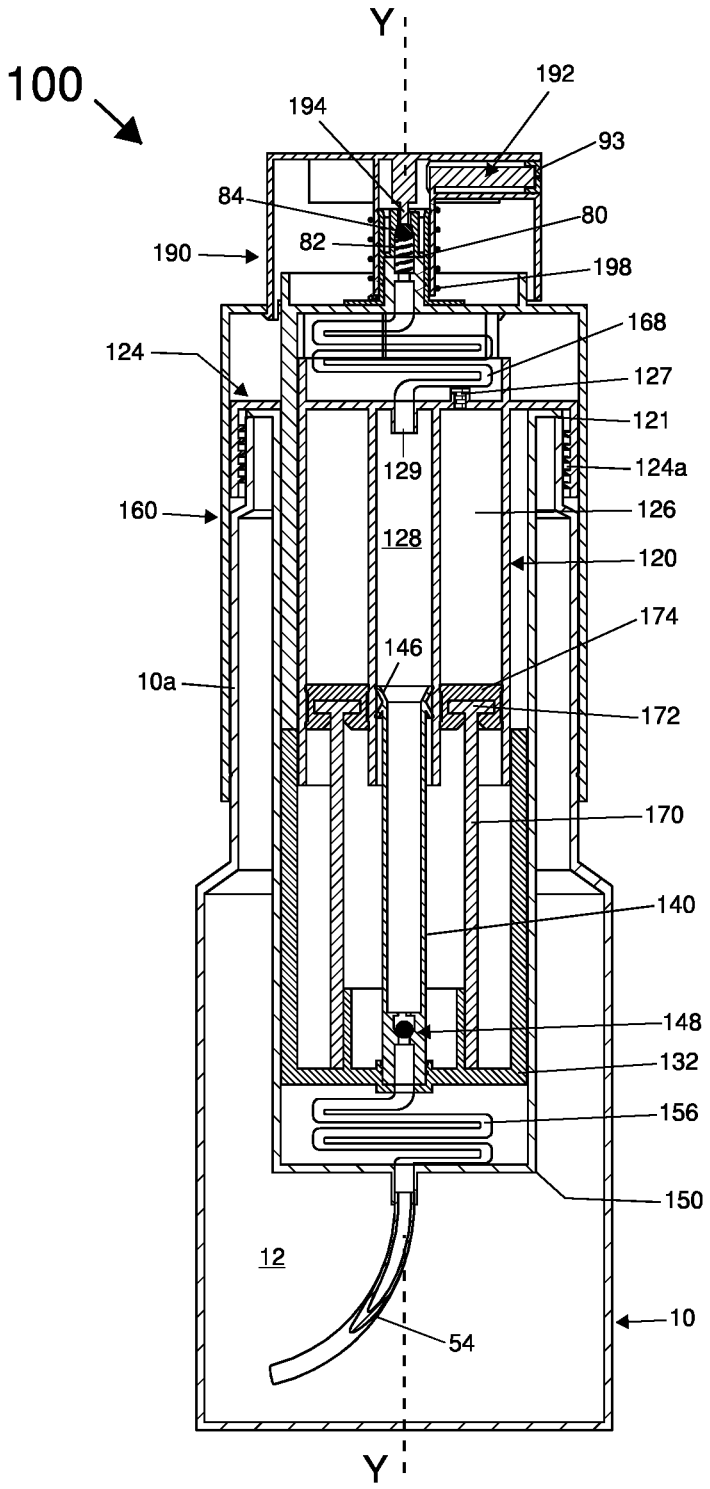
FIG. 19 is a cross-sectional view of the spray device of FIG. 10A in a fully charged configuration.

Once the device 100 is placed in the fully charged configuration illustrated in FIG. 19 and a user releases or stops depressing the charger 160, there is no longer a vacuum force in the piston chamber 128 and the interior passage 144 of the piston. The vacuum force pressurizing the quantity of liquid in the piston chamber 128 causes the ball 148*b* to engage the valve seat 148*a*, thereby placing the piston valve 148 back in the closed position and preventing any additional liquid from flowing into the interior passage 144 and the piston chamber 128. Because the piston valve 148 and valve arrangement 82, 84, 86 are closed, liquid pressure in the piston chamber 128, interior passage 144 and upper spiral tube 168 counteracts the upward force generated by the vacuum in the vacuum chamber 126, thereby locking the device 100 in the fully charged configuration.

Once the device 100 is in the fully charged configuration, the user can depress the spray actuator 190 to move the spray actuator 190 downwardly with respect to the charger 160, thereby causing the actuator pin 194 to open the valve assembly 82, 84, 86 by urging the ball 84 downwardly off of the valve seat 86, against the force of the valve spring 82. As a result, pressure in the piston chamber 128, the passage 144 and the upper spiral tube 68 is released, and the vacuum force in the vacuum chamber 126 forces plunger 170, and thus the piston 140 and plunger base 132 and the charger 160 upward with respect to the bottle body 10 and the twin cylinder 120. The upward movement of the piston 140 forces liquid to flow out of the piston chamber 128 and the interior passage 144, and then through the nozzle 192 and insert 93 as a liquid spray. The liquid spray produced by the device 100 remains continuous until the user stops depressing the spray actuator 190 or a maximum possible amount of the liquid in the piston chamber 128, the passage 144 and the upper spiral tube 168 has been sprayed out of the nozzle 192. Once the user stops depressing the spray actuator 190, the valve arrangement 82, 84, 86 returns to its closed position, thereby preventing further liquid spray from the device 100. If a maximum possible amount of the liquid in the piston chamber 128, the passage 144 and the upper spiral tube 168 is sprayed out of the nozzle 192, the device 100 is returned to its initial configuration shown in FIG. 10A by the force generated by the vacuum chamber 126.

When charging the device 100, a user can stop depressing the charger 160 before the device 100 reaches the fully charged configuration shown in FIG. 19, thereby causing the piston valve 148 to close and locking the device 100 in a partially charged configuration with the piston 140 and plunger 170 locked in their partially charged positions. Once the user stops pressing the charger 160 at any position between its initial position of FIG. 10A and its fully charged position of FIG. 19, the spray actuator 190 can be depressed to continuously spray liquid from the device 100.

Over time, because the device 100 may not be completely air-tight, if the device 100 is left in a charged configuration for an extended period of time, the vacuum force in the vacuum chamber 126 may be depleted, causing a loss of force on the plunger 170. To address this problem, the vacuum regenerator cap 127*a* (FIGS. 10A and 10B) can be removed from the vacuum regenerator port 127 while the device 100 is in the charged configuration to allow atmospheric air to enter the vacuum chamber. The device 100 can then be placed in the initial configuration to force air out of the vacuum chamber 126, and the vacuum regenerator cap 127*a* can then be reinserted into the vacuum regenerator port 127 to seal the vacuum chamber 126.

Figure 20:
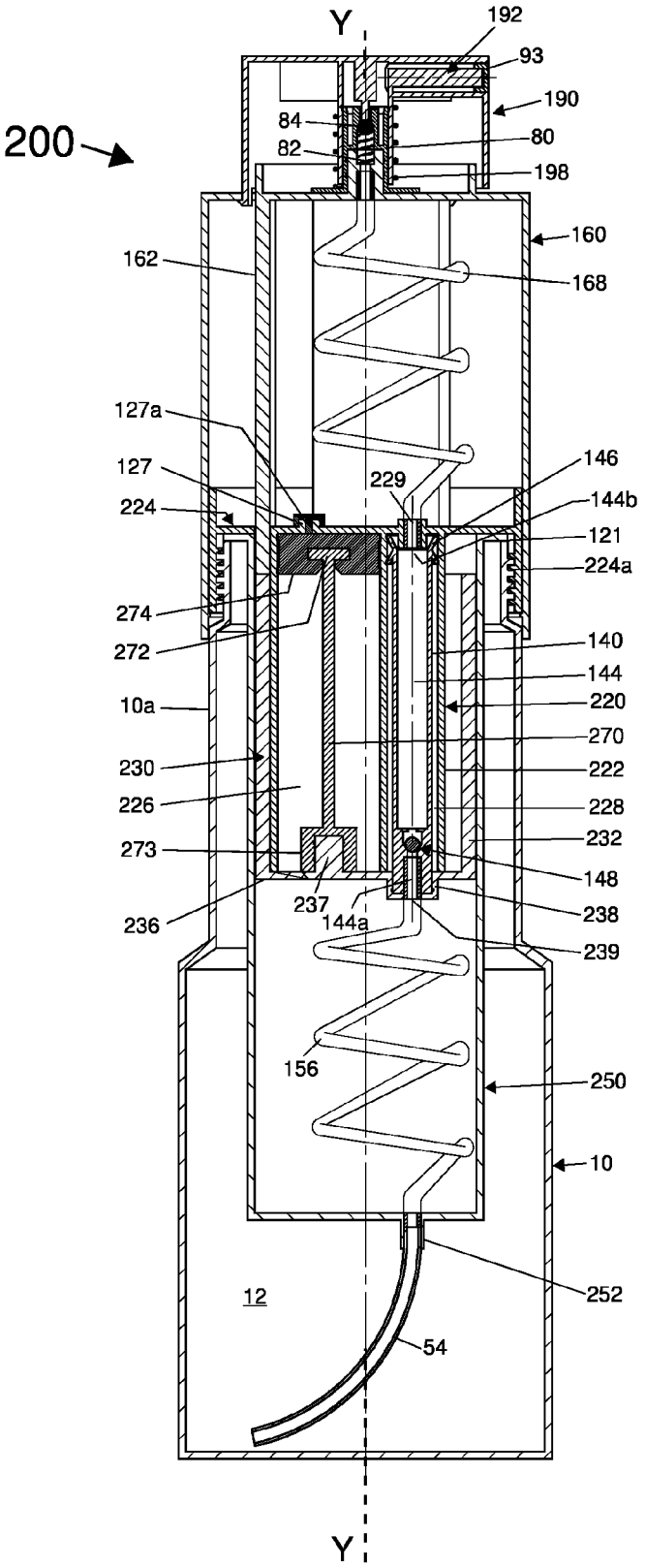
FIG. 20 is a cross-sectional view of a liquid spray device according to another embodiment of the invention, wherein the spray device is in an initial, uncharged configuration.

FIG. 20 shows a spray device 200 according to another embodiment of the invention in an initial, uncharged configuration. The device 200 is generally similar to the device 100 described above and depicted in FIGS. 10A-19, except that the device includes a piston 140 and a vacuum plunger 270 arranged in side-by-side configuration as opposed to a concentric configuration. The device 200 includes a bottle body 10 defining an interior liquid reservoir 12 containing a liquid to be sprayed from the device 200. The device 200 further includes a charger 160 that is operable to place the device 200 in a charged configuration in which the device 200 is ready to spray liquid, and a spray actuator 190 that is operable to release liquid spray from the device 200. The components of the device 200 can generally be constructed of the same materials described in the previous embodiments.

A twin cylinder 220 is fitted within an upper portion 10*a* of the bottle body 10. The twin cylinder 220 is similar to the twin cylinder 120 of the previous embodiment (FIGS. 11A-11D), except for the arrangement of the vacuum chamber 226 and the piston chamber 228. More specifically, the twin cylinder 220 includes a cylinder body 222 connected to a cylinder head 224. The cylinder head 224 can be secured to the bottle body 10 by an interference/press fit or threaded engagement between a flange 224*a* of the cylinder head 224 and an outer surface of the bottle body 10, for example. The cylinder body 222 defines the vacuum chamber 226 and a piston chamber 228, positioned side-by-side. Preferably, as is the case with the previous embodiment, the volume of the vacuum chamber 226 is larger than the volume of the piston chamber 228. The vacuum chamber 226 includes a vacuum regenerator port 127 which, during operation of the device 100, is sealed by a vacuum regenerator cap 127*a* (FIGS. 10A and 10B). The piston chamber 228 includes an exit port 229 for moving liquid out of the piston chamber 228, through the upper spiral tube 168 towards the nozzle 192 of the spray actuator 190.

Still referring to FIG. 20, a piston and plunger assembly 230 is mounted in the bottle body 10 and interfaces with the twin cylinder 220. The piston and plunger assembly 230 includes a piston and plunger base 232 fitted over the cylinder body 222, the piston 140 which is positioned to slidably reciprocate along the Y axis of the device 200 within the piston chamber 228 in order to draw liquid into the piston chamber 228 and generate liquid spray, and the vacuum plunger 270 which is positioned to slidably reciprocate along the Y axis of the device 200 within the vacuum chamber 226 in order to create a vacuum in the vacuum chamber 226. The piston and plunger base 232 is similar to the piston and plunger base 132 of the previous embodiment (FIGS. 12A-12C), except for a differing arrangement of the plunger seat 237 and the piston seat 238, which in this case are position side-by-side to consequently place the piston 240 and the vacuum plunger 270 side-by-side. The piston seat 238 includes a port 239.

The vacuum plunger 270 is a generally rod-shaped member having a disc-shaped head 272 at its top end. An annular seal 274 is attached to the plunger head 272 to provide a tight, interference fit with the interior walls of the vacuum chamber 226 such that a vacuum can be created and maintained in the vacuum chamber 226. As in the previous embodiment shown in FIGS. 10A-19, the seal 274 can be constructed of an elastomeric material such as rubber or silicone, for example.

A piston and plunger base housing 250 is mounted in the bottle body 10 and is fitted around the piston and plunger base 232. The piston and plunger base 250 is a generally hollow, cylindrical body and includes a nipple 252 at its bottom end. A dip tube 54 is attached to the nipple 252 and extends into the liquid reservoir 12. A lower spiral tube 156 is connected to the nipple 252 at the interior of the piston base housing 250, and extends to the port 239 of the piston and plunger base 232 and the liquid inlet opening 144*a* of the piston 140.

The device 200 operates essentially in the same manner as the device 100 described in FIGS. 10A-19. Accordingly, in the interest of conciseness, the operation of the device 200 will not be described in further detail.

A spray device 300 according to yet another embodiment is shown in FIGS. 21A-21D. The device 300 is similar in concept to the devices 100 and 200 described above, except that the device 300 includes a mechanical assist feature that makes it easier to charge the device 300. Therefore, the design of the device 300 can be implemented in larger devices with greater liquid capacities without requiring a user to apply an inordinate amount of force to charge the device for spraying.

Figure 21A:
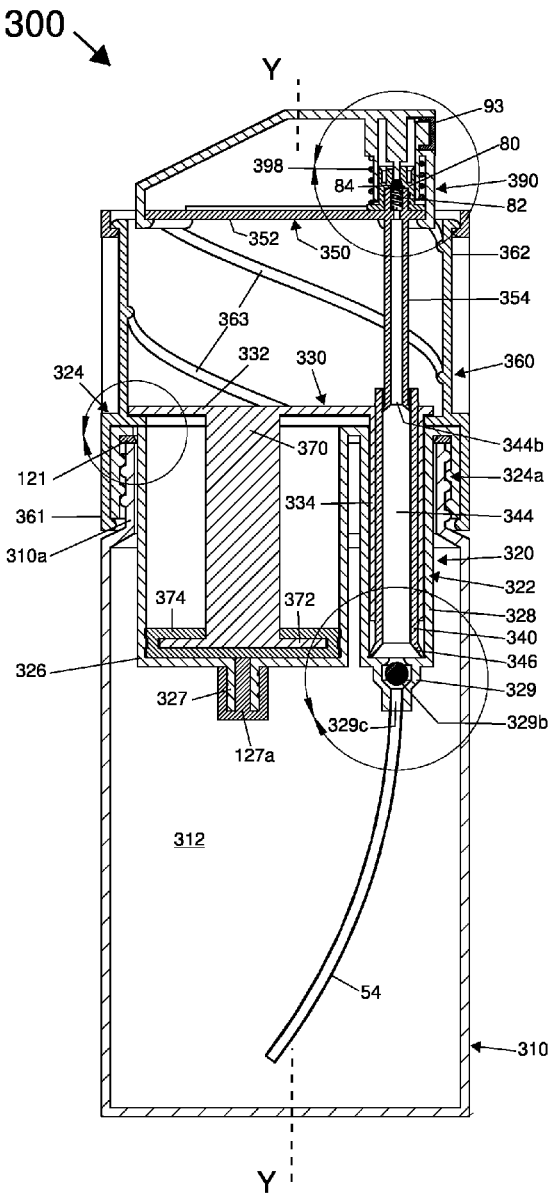
FIG. 21A is a cross-sectional view of a liquid spray device according to yet another embodiment of the invention, wherein the spray device is in an initial, uncharged, configuration.

As illustrated in FIG. 21A, the device 300 includes a bottle body 310 for supporting and housing various components of the device 300, and defining an interior liquid reservoir 312 for containing a liquid to be sprayed from the device 300. The device 300 further includes a charger 360 that is operable to place the device 300 in a charged configuration in which the device 300 is ready to spray liquid, and a spray actuator 390 that is operable to release liquid spray from the device 300. As in the previous embodiments, bottle body 310, charger 360 and spray actuator 390 can each be constructed of a suitably rigid material such as plastic, metal or steel, for example, but preferably a lightweight plastic material.

Still referring to FIG. 21A, a twin cylinder 320 is fitted within an upper portion 310*a* of the bottle body 310. As shown in FIGS. 22A-22E, the twin cylinder 320 includes a cylinder body 322 connected to a cylinder head 324. The cylinder head 324 can be secured to the bottle body 310 by an interference/press fit or threaded engagement between a flange 324*a* of the cylinder head 324 and an outer surface of the bottle body 310, for example. The cylinder body 322 includes a hollow, cylindrical vacuum chamber 326 and a hollow, cylindrical piston chamber 328, with the chambers 326, 328 being located laterally adjacent to each other. Preferably, the volume of the vacuum chamber 326 is larger than the volume of the piston chamber 328. The vacuum chamber 326 includes an open top 326*a* and a bottom end 326*b* with a vacuum regenerator port 327 sealed by a vacuum regenerator cap 127*a* (FIG. 21A). An air duck bill 121 communicates with the liquid reservoir 312 and allows air from the atmosphere to be suctioned into the liquid reservoir 312 while preventing liquid, when present, in the liquid reservoir 312 from being released to the atmosphere. The piston chamber 328 includes an open top 328*a* and an inlet valve 329 at its bottom end 328*b*. The inlet valve 329 includes a valve seat 329*a*, a ball 329*b* that can be selectively moved into and out of the seat 329*a* (FIG. 21B), and an inlet port 329*c*. A dip tube 54 is connected to the inlet port 329*c* and extends into the liquid reservoir 312 to place the piston chamber 328 in fluid communication with the liquid reservoir 312. As illustrated in FIGS. 21A, 21B the inlet valve 329 is biased in a closed position in which the ball 329*b* is seated within the valve seat 329*a*, blocking liquid flow into the piston chamber 328 through the inlet port 329*c*. The twin cylinder 320 can be constructed of a suitably rigid material such as plastic, metal or steel, for example. However a lightweight plastic material is preferred.

A piston and plunger assembly 330 is mounted in the bottle body 310 and interfaces with the twin cylinder 320. The piston and plunger assembly 330 includes base member 332, a tubular piston mount 334 (FIGS. 23A-23C and 23E) extending from the base member 334, a piston 340 that is received in the piston mount 334 positioned to slidably reciprocate together with the piston mount 334 along the Y axis of the device 300 within the piston chamber 328, and a vacuum plunger 370 that extends from the base member 332 and is positioned side-by-side with the piston 340 to slidably reciprocate along the Y axis of the device 300 within the vacuum chamber 326 in order to create a vacuum in the vacuum chamber 326. The piston assembly 330 is preferably constructed of a lightweight plastic material, for example. However, other materials such as a metal or steel can be used.

Referring to FIGS. 23A-23E, the base member 332 is a substantially disc-shaped member having a plurality of radially projecting teeth 332*a* configured to engage the charger 360. The piston mount 334 is sized to receive and secure a piston 340, as will be described later. The vacuum plunger 370 has a disc-shaped plunger head 372 at its top end. Turning to FIGS. 21A, 21B and 24A-24D, an annular seal 374 is attached to the plunger head 372 to provide a tight, interference fit with the interior walls of the vacuum chamber 326 such that a vacuum can be created and maintained in the vacuum chamber 326. The seal 374 can be constructed of an elastomeric material such as rubber or silicone, for example.

Referencing FIG. 21A, the piston 340 is configured to fit within the piston mount 334. The piston 340 can be secured to the piston mount 334 by an interference fit and/or adhesive, or by other attachment means. As illustrated in FIGS. 21A, 21*b* and 25A-25E, the piston 340 includes a piston head 346 at bottom end of the piston 340. An interior liquid passage 344 begins at an inlet opening 344*a* in the piston head 346 and terminates at an exit opening 344*b* at a top end of the piston 340. The inlet opening 344*a* is aligned with the inlet port 329*c* of the piston chamber 328. Radially protruding ridges 347 (FIG. 25A) can be formed near the top and bottom ends of the piston 340 to precisely place the piston 340 in the piston mount 334.

Referring back to FIG. 21A, the charger 360 is secured over the twin cylinder 320. As illustrated in FIGS. 26A-26D, the charger 360 is a substantially hollow, cylindrical member having open bottom and top ends 360*a*, 360*b*, a lower portion 361 rotatably attached to the twin cylinder 320, and an upper portion 362 in intermeshing engagement with the piston and plunger assembly 330. The upper portion 362 includes internal threads 363 configured to engage the teeth 332*a* (FIG. 23C) of the base member 332 to turn the base member 332 upon a user turning the charger 360 (clockwise in the embodiment shown). Turning the charger 360 clockwise moves the plunger 370 upwardly within the vacuum chamber 326 to create a vacuum in the vacuum chamber 326, and simultaneously moves the piston 340 upwardly within the piston chamber 328 to create a vacuum in the piston chamber 328 to draw liquid, when present, from the reservoir 312 into the piston chamber 328.

Preferably, the threads 363 of the charger 360 have a 45-degree pitch in order to provide an equal balance of charging efficiency (upward motion of the piston and plunger assembly 330 during charging of the device 300) and spraying efficiency (upward motion of the piston and plunger assembly 330 during spraying of liquid). However, other pitch angles can be used for the threads 363 to provide different charging and spray characteristics. To facilitate gripping and turning of the charger 360, the exterior side wall of the upper portion 362 of the charger 360 can include ribs or ridges 364.

As shown in FIG. 21A, an actuator base 350 is attached to the charger 360. More specifically, as illustrated in FIGS. 27A-27E, the actuator base 350 includes a disc-shaped portion 352 attached to the top end of the charger 360 (FIG. 21A), and a cylinder outlet tube 354 that extends from the disc-shaped portion 352 and is received in the passage 344 of the piston 340 to allow liquid to flow out of the piston chamber 328 and the passage 344 and into the actuator 390. The cylinder outlet tube 354 includes a nipple 356 that extends from a top surface of the disc-shaped portion 352.

Figure 21D:
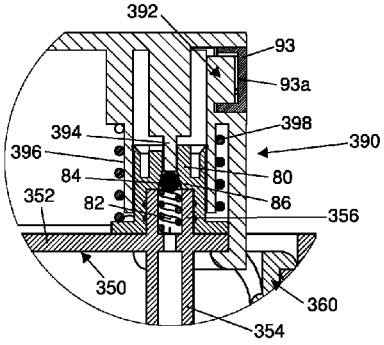
FIGS. 21B-21D are cut-away views showing components of the spray device of FIG. 21A.
Figure 21C:
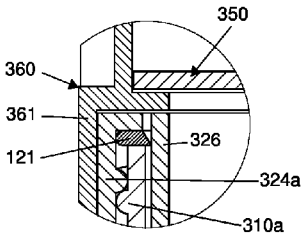
Figure 21B:
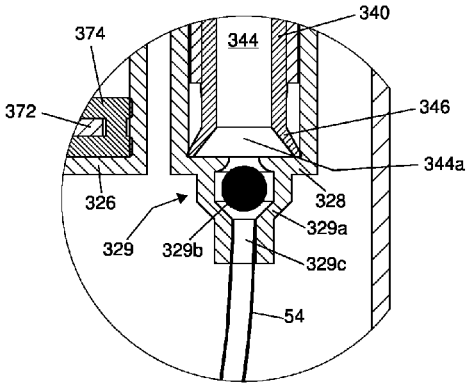
Figure 22E:
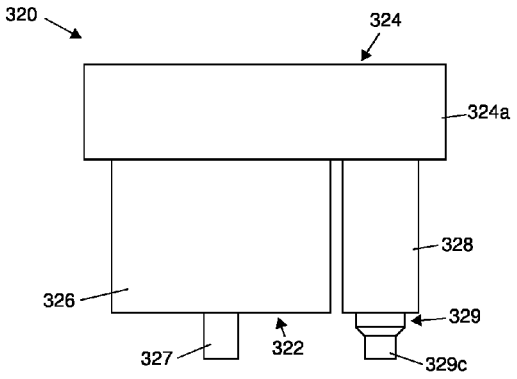
FIGS. 22A-22E are cross-sectional, perspective, top, side and front views of a twin cylinder of the spray device of FIG. 21A.
Figure 22D:
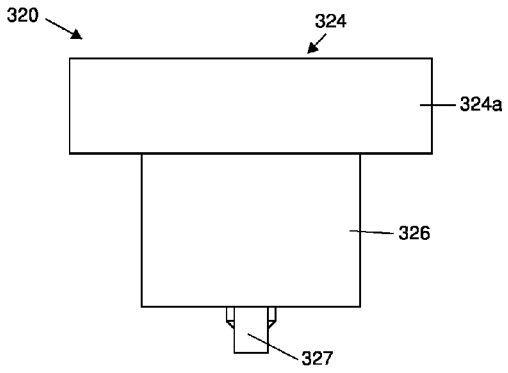
Figure 22C:
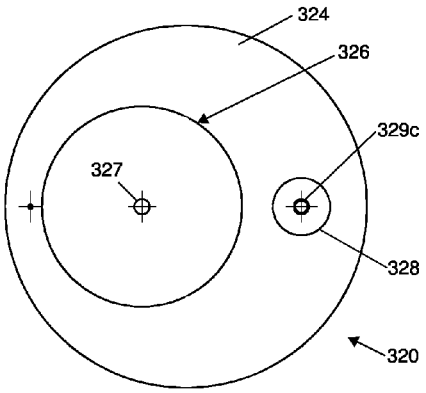
Figure 22B:
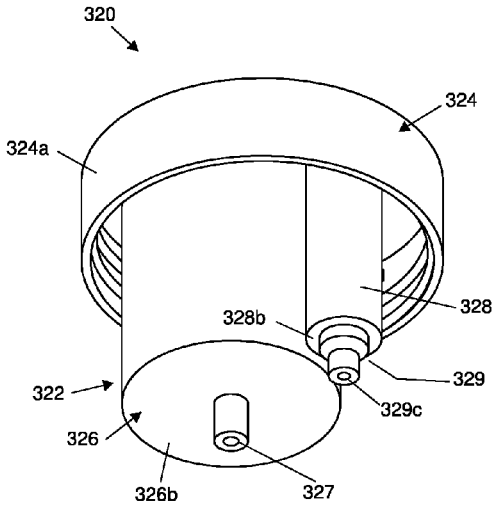
Figure 22A:
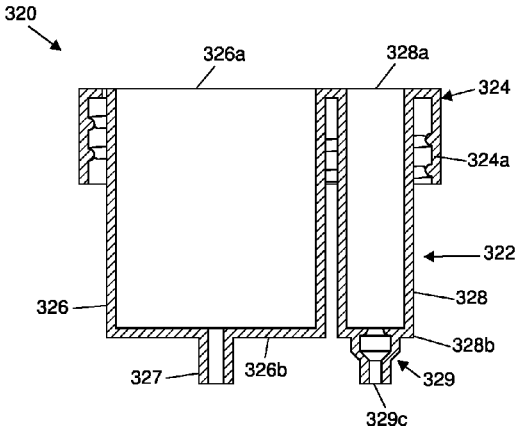
Figure 23E:
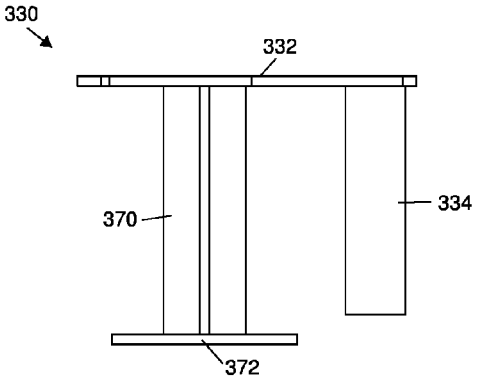
FIGS. 23A-23E are cross-sectional, perspective, top, side and front views of a plunger and a piston mount of the spray device of FIG. 21A.
Figure 23D:
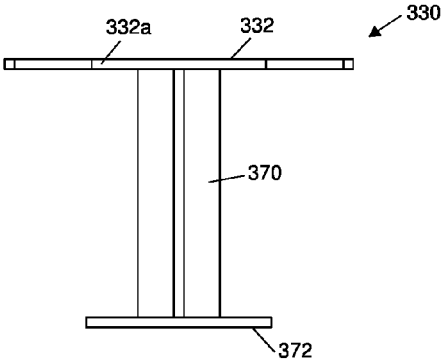
Figure 23C:
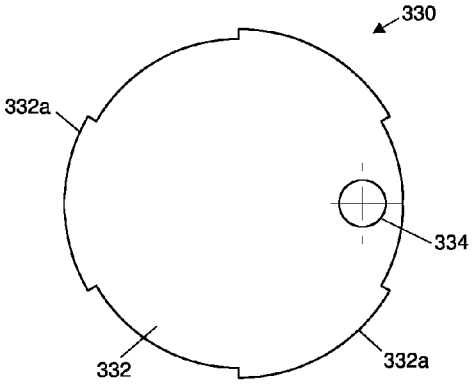
Figure 23B:
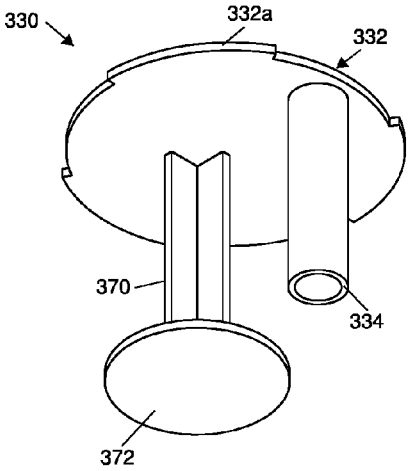
Figure 23A:
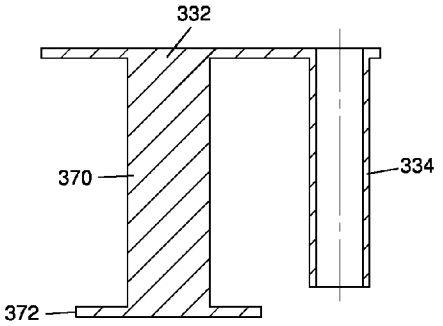
Figure 24D:
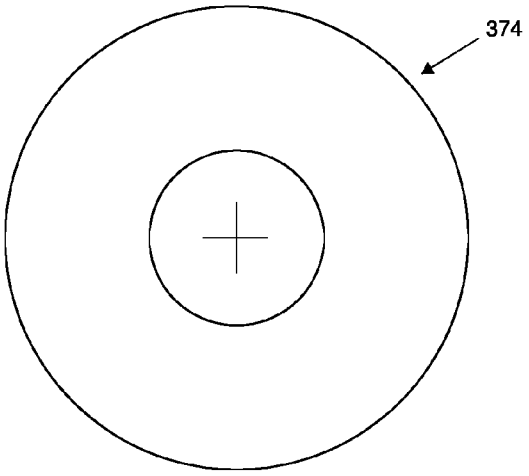
FIGS. 24A-24D are cross-sectional, perspective, side and top views of a vacuum seal of the spray device of FIG. 21A.
Figure 24C:
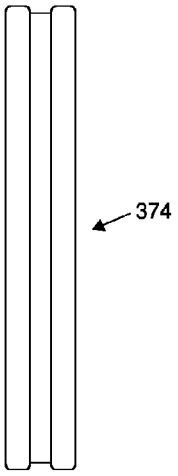
Figure 24A:
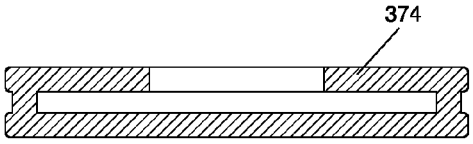
Figure 24B:
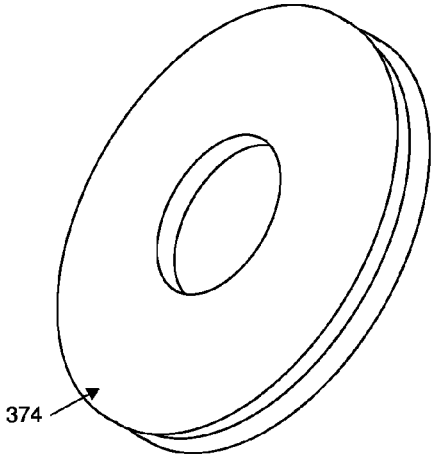
Figure 25E:
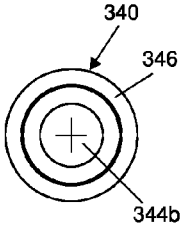
FIGS. 25A-25E are cross-sectional, perspective, cut-away, side and top views of a piston of the spray device of FIG. 21A.
Figure 25D:
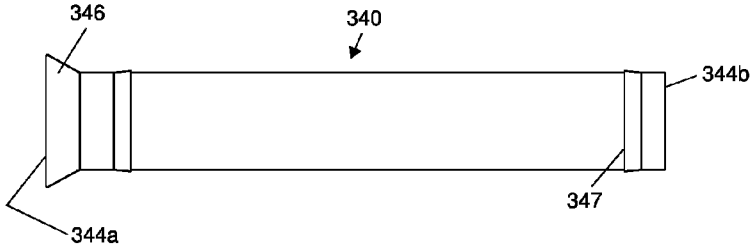
Figure 25A:
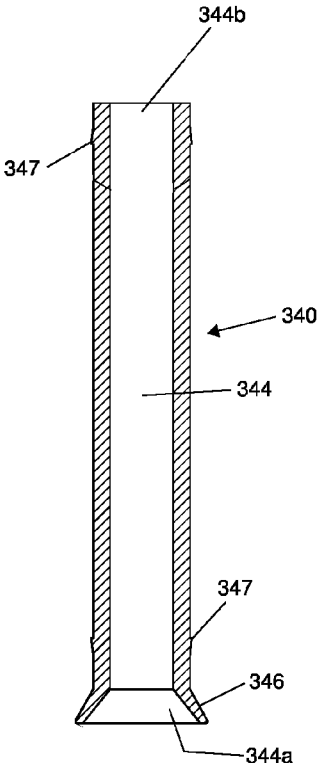
Figure 25C:
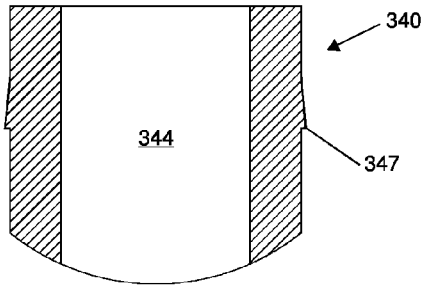
Figure 25B:
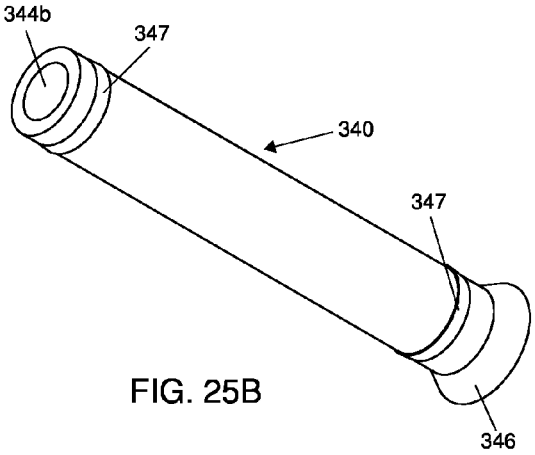
Figure 26D:
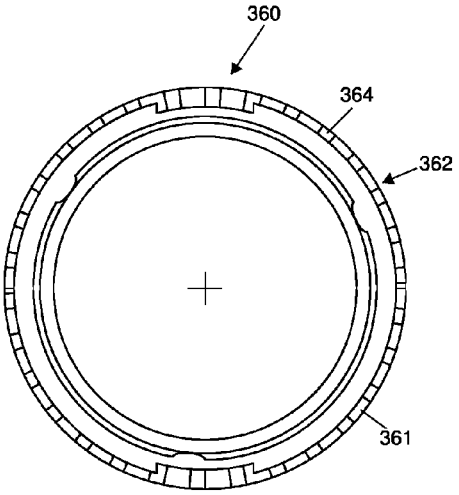
FIGS. 26A-26D are cross-sectional, perspective, side and top views of a charger of the spray device of FIG. 21A.
Figure 26C:
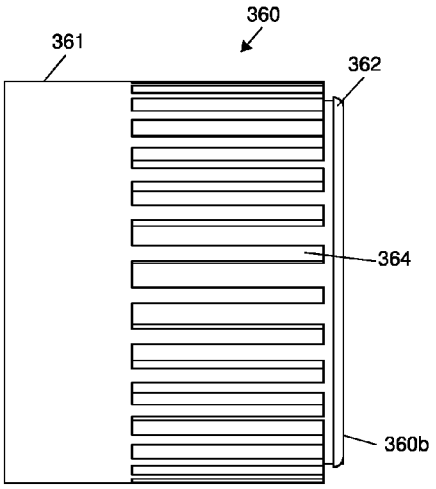
Figure 26A:
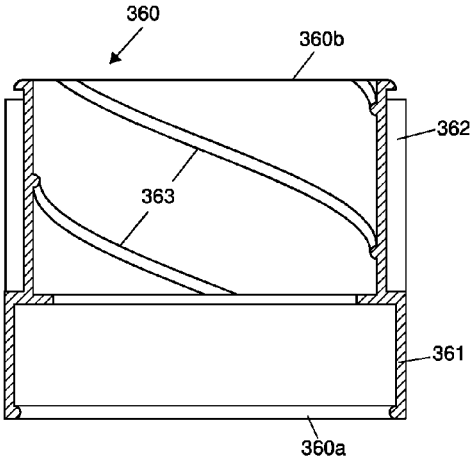
Figure 26B:
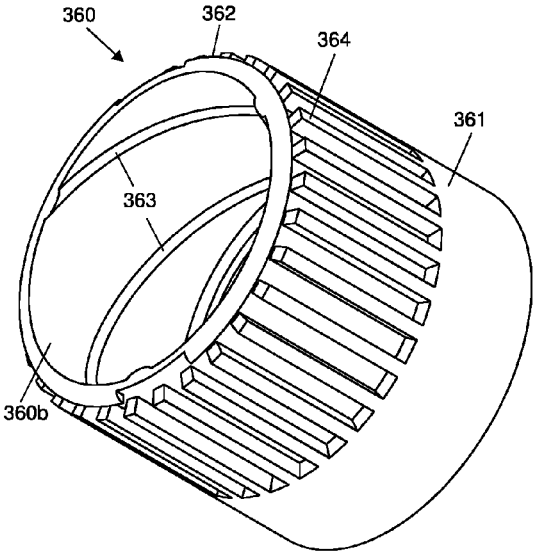
Figure 27E:
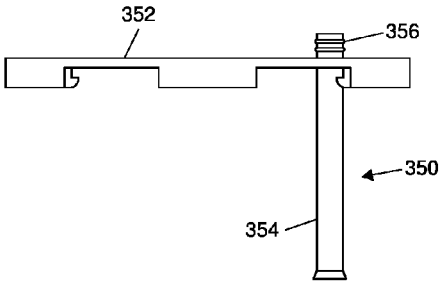
FIGS. 27A-27E are cross-sectional, perspective, top, side and front views of an actuator base of the spray device of FIG. 21A.
Figure 27D:
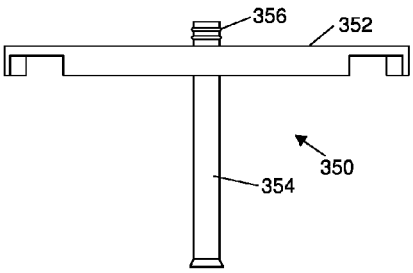
Figure 27C:
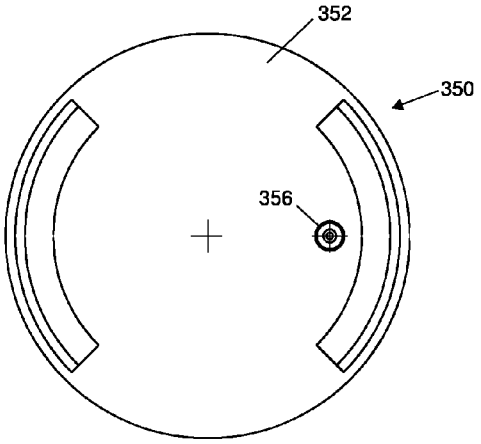
Figure 27B:
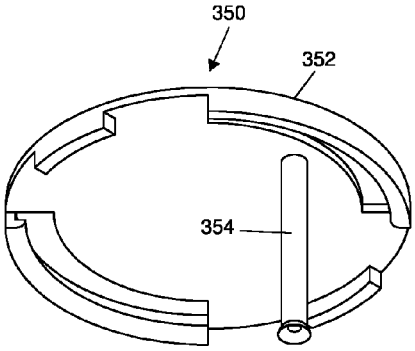
Figure 27A:
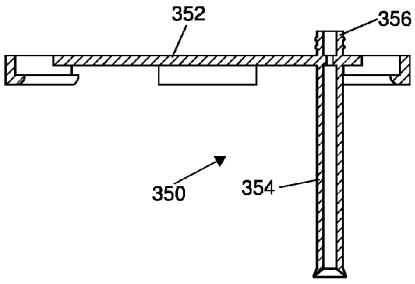
Figure 28E:
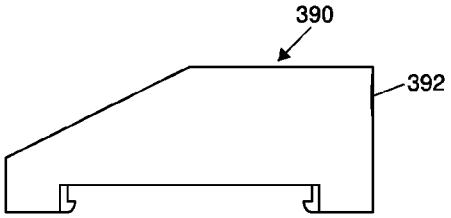
FIGS. 28A-28E are cross-sectional, perspective, top, side and front views of a spray actuator of the spray device of FIG. 21A.
Figure 28D:
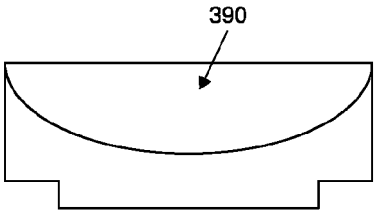
Figure 28C:
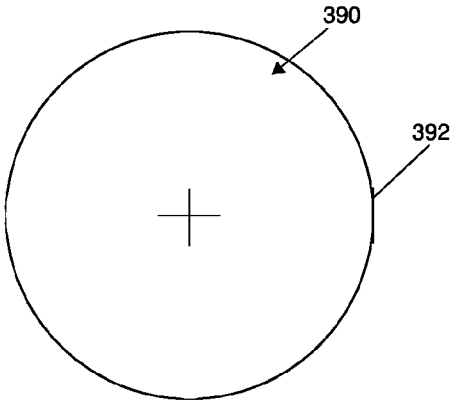
Figure 28B:
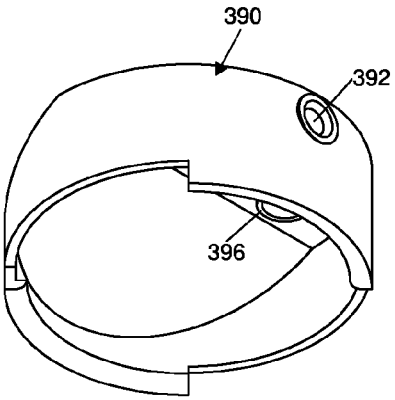
Figure 28A:
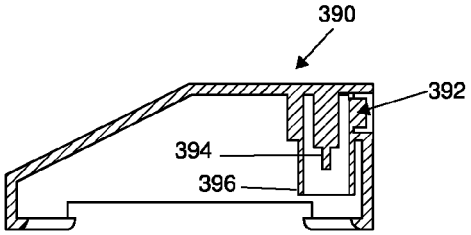

As illustrated in FIGS. 21A and 21D, a valve cap 80 is fitted over the nipple 356 of the actuator base 350. The valve cap 80, includes a ball valve arrangement including a valve spring 82, received in the nipple 356, that biases a ball 84 upwardly into a seated position within a valve seat 86 such that the ball valve arrangement 82, 84, 86 is in a closed configuration, thereby blocking liquid flow out of the nipple 66.

The actuator 390 is attached to the actuator base 350. As illustrated in FIGS. 21D and 28A-28E, the spray actuator 390 has the form of a generally cylindrical cap and is attached at its bottom end to the actuator base 350. The actuator 390 includes a spray nozzle 392, an actuator pin or rod 394 and a mounting post 396. Referring back to FIG. 21D, the mounting post 396 is fitted over the nipple 356 of the actuator base 350 to secure the spray actuator 390 to the charger such that the actuator pin 394 is aligned with and positioned to engage the ball 84 in the valve cap 80. A biasing spring 398 is positioned over the mounting post 396 and engages the spray actuator 390 to bias the spray actuator in an extended position in which the ball valve arrangement 82, 84, 86 is in the closed configuration, thereby preventing liquid spray from the nozzle 392. The nozzle 392 can be fitted with an insert 93 (FIG. 21A) to change the spray pattern of the device 300 as desired.

The operation of the device 300 will now be described with reference to FIGS. 21A and 29.

In FIG. 21A, the device 300 is in an initial configuration in which it is not prepared to spray liquid from the liquid reservoir 312. In this position, the piston 340 and the plunger 370 are at the lowermost positions of their strokes, and a bottom end of the cylinder outlet tube 354 is positioned in the pathway 344 at the top end of the piston 340. In order to charge the device 300, the charger 360 is turned clockwise with respect to the bottle body 310. As the charger 360 is turned clockwise, the threads 363 of the charger 360 engage the teeth 332*a* (FIG. 23C) of the piston and plunger assembly 330, causing the piston and plunger assembly 330 to rotate about the Y axis and move upwardly, thereby simultaneously moving (translating) the piston 340 and the vacuum plunger 370 upwardly within the piston chamber 328 and the vacuum chamber 326, respectively. As the piston 340 moves upwardly, the cylinder outlet tube 354 moves downwardly in the passage 344, and the piston 340 generates a vacuum force in the interior passage 344, the piston chamber 328 and the cylinder outlet tube 354. The vacuum in the interior passage 344, the piston chamber 328 and the cylinder outlet tube 354 opens the inlet valve 329 by causing the ball 329*b* to be lifted from the valve seat 329*a* and enabling liquid to enter the piston chamber 328 from the reservoir 312 to fill the void created by the vacuum in the interior passage 344, the piston chamber 328 and the cylinder outlet tube 354. As the plunger 370 moves upwardly, a vacuum is created in the vacuum chamber 326, resulting in a downward force acting on the plunger 370 and the piston 340. Thus, turning the charger 360 clockwise charges the device 300 by loading the passage 344, the piston chamber 328 and the cylinder outlet tube 354 with liquid and pressurizing the liquid in the passage 344, the piston chamber 328 and the cylinder outlet tube 354 with the force of the piston 340 due to the vacuum in the vacuum chamber 326. The charger 360 can be turned until the device 300 is placed in its fully charged configuration shown in FIG. 29. When the device 300 is in the fully charged configuration, the piston 340 and plunger 370 are locked in their fully charged positions such that the piston head 346 and plunger head 372 are at the uppermost positions of their strokes, and the bottom end of the cylinder outlet tube 354 is maximally inserted in the pathway 344.

Figure 29:
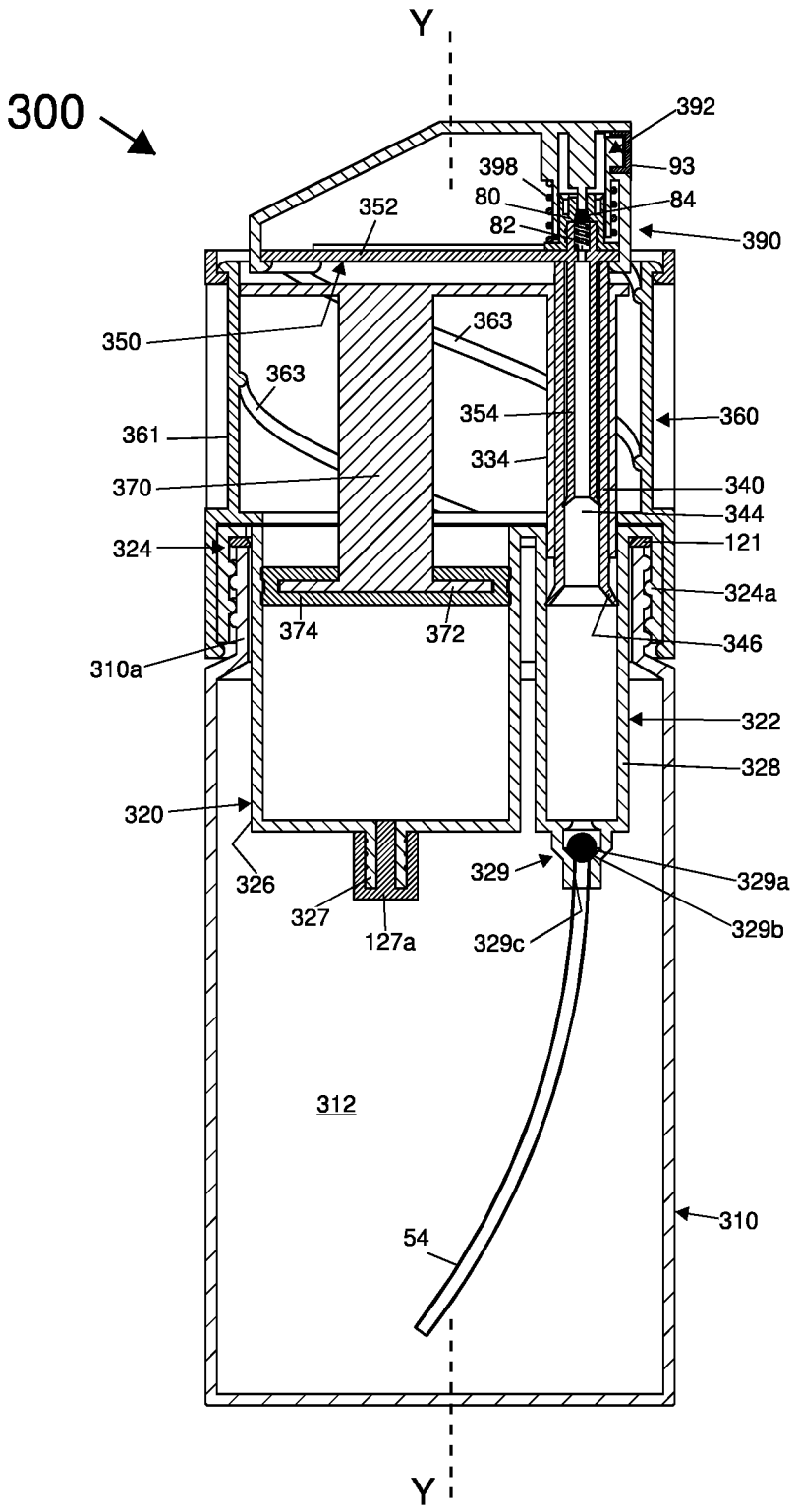
FIG. 29 shows the spray device of FIG. 21A in a fully charged configuration.

Once the device 300 is placed in the fully charged configuration illustrated in FIG. 29 and a user releases or stops turning the charger 360, there is no longer a vacuum force in the piston chamber 328, the interior passage 344 of the piston 340, and the cylinder outlet tube 354. The vacuum force pressurizing the quantity of liquid in the piston chamber 328 causes the ball 329*b* to engage the valve seat 329*a*, thereby placing the inlet valve 329 back in the closed position and preventing any additional liquid from flowing into the interior passage 344 and the piston chamber 328. Because the inlet valve 329 and valve arrangement 82, 84, 86 are closed, liquid pressure in the piston chamber 328, the interior passage 344 and the cylinder outlet tube 354 counteracts the downward force generated by the vacuum in the vacuum chamber 326, thereby locking the device 300 in the fully charged configuration.

Once the device 300 is in the fully charged configuration, the user can depress the spray actuator 390 to move the spray actuator 390 downwardly with respect to the actuator base 350, thereby causing the actuator pin 394 (FIG. 28A) to open the valve assembly 82, 84, 86 by urging the ball 84 downwardly off of the valve seat 86, against the force of the valve spring 82. As a result, pressure in the piston chamber 328, the passage 344 and the cylinder outlet tube 354 is released, and the vacuum force in the vacuum chamber 326 forces plunger 370, and thus the piston 340 downward with respect to the vacuum chamber 326 and the piston chamber 328, respectively. As the plunger 370 and piston 340 move downwardly, the piston 340 forces liquid to flow out of the piston chamber 328, the interior passage 344, and the cylinder outlet tube 354, and then through the nozzle 392 as a liquid spray. The piston and plunger assembly 330 rotates counterclockwise as the teeth 332*a* follow the threads 363 during downward movement of the plunger 370 and piston 340. The liquid spray produced by the device 300 remains continuous until the user stops depressing the spray actuator 390 or a maximum possible amount of the liquid in the piston chamber 328, the passage 344 and the cylinder outlet tube 354 has been sprayed out of the nozzle 392. Once the user stops depressing the spray actuator 390, the valve arrangement 82, 84, 86 returns to its closed position, thereby preventing further liquid spray from the device 300. If a maximum possible amount of the liquid in the piston chamber 328, the passage 344 and the cylinder outlet tube 354 is sprayed out of the nozzle 192, the device 300 is returned to its initial configuration shown in FIG. 21A by the force generated by the vacuum chamber 326.

When charging the device 300, a user can stop turning the charger 360 before the device 300 reaches the fully charged configuration shown in FIG. 29, thereby causing the inlet valve 329 to close and locking the device 300 in a partially charged configuration with the piston 340 and plunger 370 locked in their partially charged positions. Once the user stops turning the charger 360 at any position between its initial rotational position of FIG. 21A and its rotational position in the fully charged configuration of FIG. 29, the spray actuator 390 can be depressed to continuously spray liquid from the device 300.

Although the device 300 is shown and described with a piston 340 and vacuum plunger 370 in side-by-side arrangement, it should be understood that the device could be reconfigured to arrange the piston and vacuum plunger in a concentric arrangement.

Figure 30:
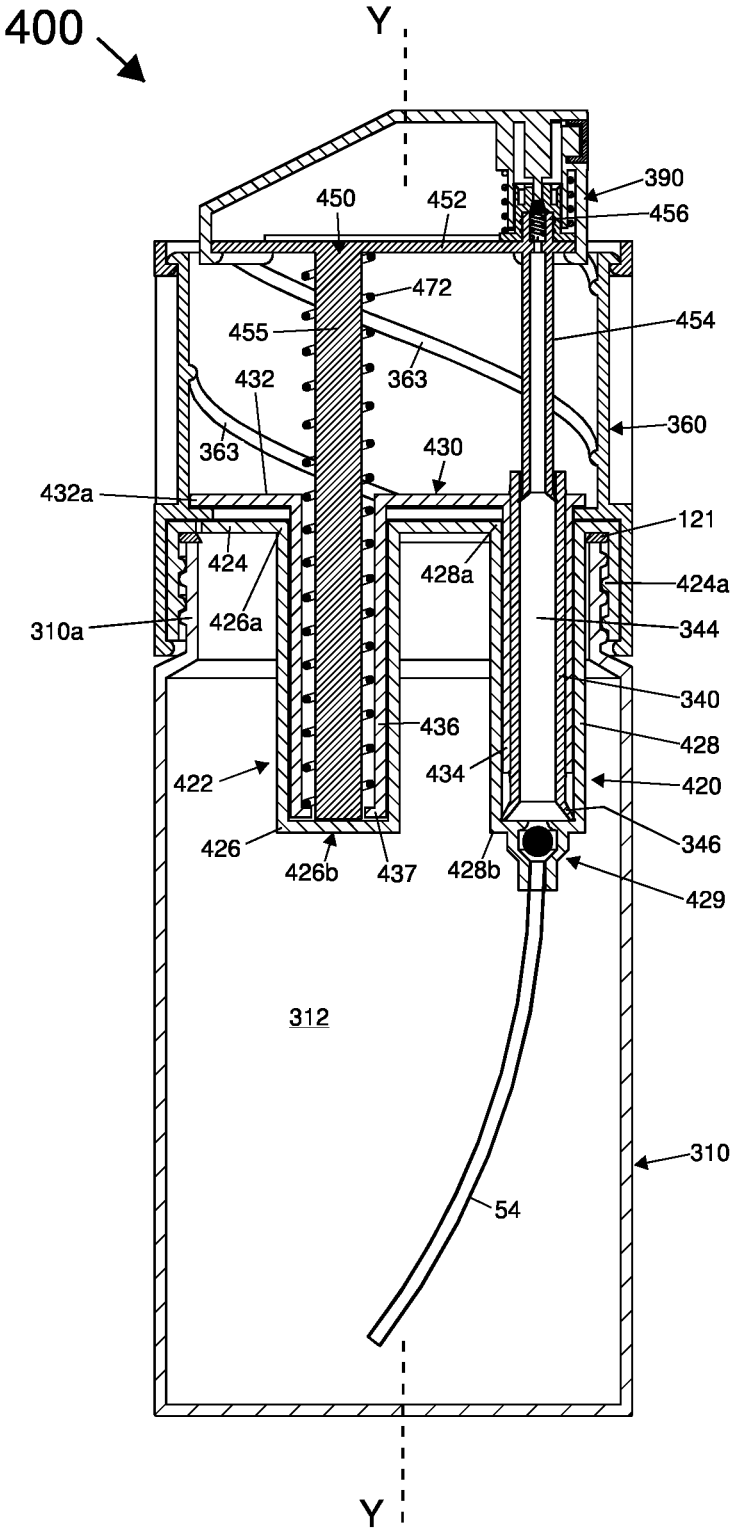
FIG. 30 is a cross-sectional view of a liquid spray device according to another embodiment of the invention, wherein the spray device is in an initial, uncharged configuration.

A spray device 400 according to yet another embodiment is shown in FIG. 30. The device 400 is essentially a spring-powered version of the device 300 of the previous embodiment, and is similar to the device 300 with except that the device 400 includes a twin cylinder 420 in place of the twin cylinder 320, a piston and spring driver assembly 430 in place of the piston and plunger assembly 330, and an actuator base 450 in place of the actuator base 350.

The twin cylinder 420 includes a cylinder body 422 connected to a cylinder head 424. The cylinder head 424 can be secured to the bottle body 310 by an interference/press fit or threaded engagement between a flange 424*a* of the cylinder head 424 and an outer surface of the bottle body 310, for example. The cylinder body 422 includes a hollow, cylindrical spring chamber 426 and a hollow, cylindrical piston chamber 428, with the chambers 426, 428 being located laterally adjacent to each other. The spring chamber 426 includes an open top 426*a* and a closed bottom end 426*b*. The piston chamber 428 includes an open top 428*a* and an inlet valve 429 (similar to the inlet valve 329 of the previous embodiment) at its bottom end 428*b*.

Still referencing FIG. 30, the piston and spring driver assembly 430 is mounted in the bottle body 310 and interfaces with the twin cylinder 420. The piston and spring driver assembly 430 includes base member 432, a tubular piston mount 434, a piston 340 that is received in the piston mount 434 positioned to slidably reciprocate together with the piston mount 434 along the Y axis of the device 400 within the piston chamber 428, and tubular spring seat 436 that is positioned side-by-side with the piston 340 to slidably reciprocate along the Y axis of the device 300 within the spring chamber 426 in order to operate a power spring 472. The base member 432 is a substantially disc-shaped member having a plurality of radially projecting teeth 432*a* configured to engage the internal threads 363 of the charger 360.

The actuator base 450 is attached to the charger 360 and supports the spray actuator 390. The actuator base 450 includes a disc-shaped portion 452 attached to the top end of the charger 360, a cylinder outlet tube 454 that extends from the disc-shaped portion and is received in the passage 344 of the piston 340 to allow liquid to flow out of the piston chamber 428 and the passage 344 and into the actuator 390, and a spring rod 456 extending from the disc-shaped portion 452 and into the spring seat 436 to support the power spring 472. The cylinder outlet tube 454 includes a nipple 456 that extends from a top surface of the disc-shaped portion 452.

The power spring 472 is coaxially fitted over the spring rod 455 and received within the spring seat 436 of the piston and spring driver assembly 430, with a bottom end of the power spring 472 being engaged by a radially projecting ledge 437 at the bottom of the spring seat 436. Thus, the power spring 472 is supported and guided by the spring seat 436 and the spring rod 455 as it the spring 472 is compressed and extended by reciprocating motion of the piston and spring driver assembly 430 along the Y axis.

The operation of the device 400 will now be described with reference to FIGS. 30 and 31.

In FIG. 30, the device 400 is in an initial configuration in which it is not prepared to spray liquid from the liquid reservoir 312. In this position, the piston 340 is at the lowermost positions of its stroke, the power spring 472 is fully extended and a bottom end of the cylinder outlet tube 454 is positioned in the pathway 344 at the top end of the piston 340. In order to charge the device 300, the charger 360 is turned clockwise with respect to the bottle body 310. As the charger 360 is turned clockwise, the threads 363 of the charger 360 engage the teeth 432*a* of the piston and spring driver assembly 430, causing the piston and spring driver assembly 430 to rotate about the Y axis and move upwardly, thereby simultaneously moving the piston 340 upwardly within the piston chamber 428 and compressing the power spring 472. As the piston 340 moves upwardly, the cylinder outlet tube 454 moves downwardly in the passage 344, and the piston 340 generates a vacuum force in the interior passage 344, the piston chamber 428 and the cylinder outlet tube 454. The vacuum in the interior passage 344, the piston chamber 428 and the cylinder outlet tube 454 opens the inlet valve 429 and enables liquid to enter the piston chamber 428 from the reservoir 312 to fill the void created by the vacuum in the interior passage 344, the piston chamber 428 and the cylinder outlet tube 454. As the power spring 472 compresses, it generates a downward force acting on the piston and spring driver assembly 430 (and, therefore, the piston 340). Thus, turning the charger 360 clockwise charges the device 400 by loading the passage 344, the piston chamber 428 and the cylinder outlet tube 454 with liquid and pressurizing the liquid in the passage 344, the piston chamber 428 and the cylinder outlet tube 454 with the force of the piston 340 due to the force generated by the power spring 472. The charger 360 can be turned until the device 400 is placed in its fully charged configuration shown in FIG. 31. When the device 400 is in the fully charged configuration, the piston 340 and power spring 472 are locked in their fully charged positions such that the piston head 346 is at the uppermost positions of its stroke, the power spring 472 is fully compressed and the bottom end of the cylinder outlet tube 454 is maximally inserted in the pathway 344.

Figure 31:
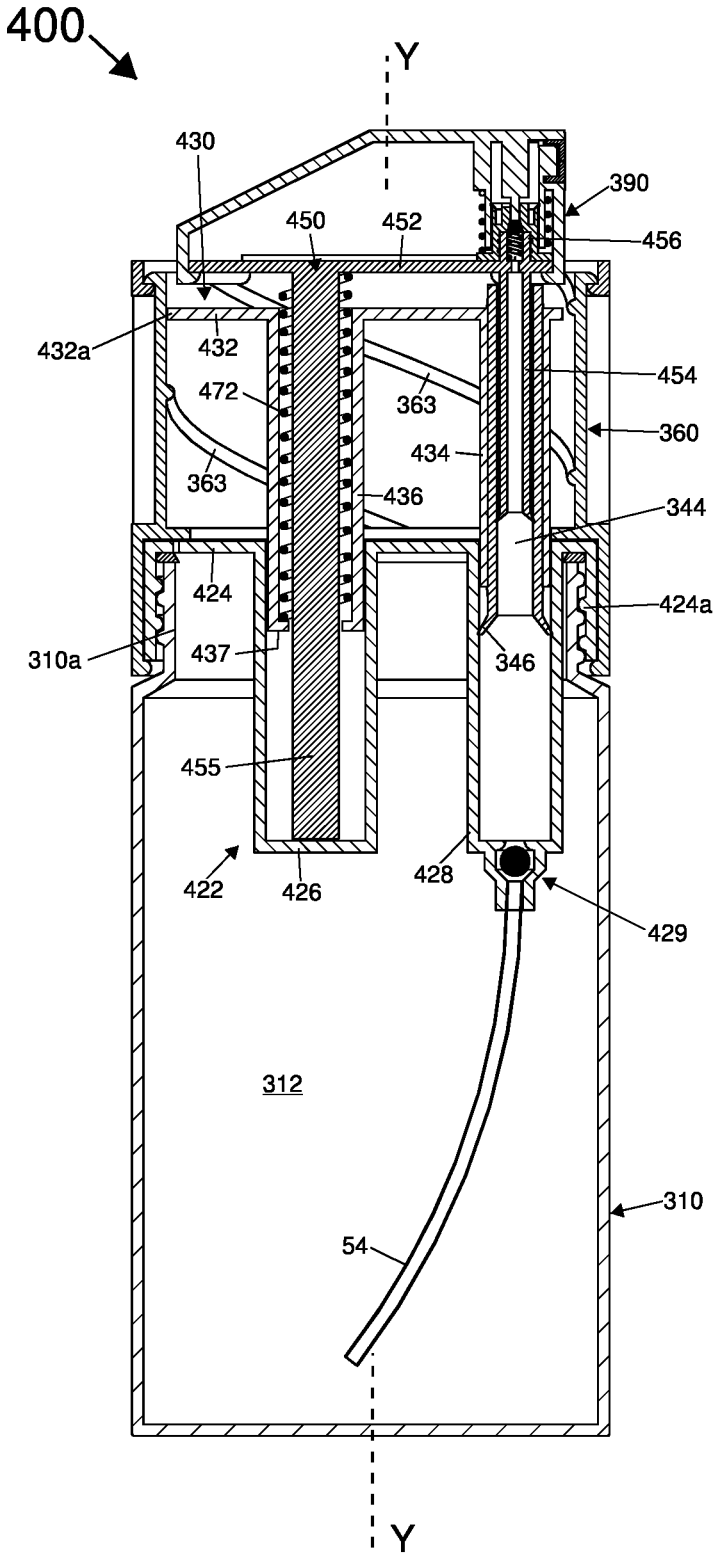
FIG. 31 shows the spray device of FIG. 30 in a fully charged configuration.

Once the device 400 is placed in the fully charged configuration illustrated in FIG. 31 and a user releases or stops turning the charger 360, there is no longer a vacuum force in the piston chamber 428, the interior passage 344 of the piston 340, and the cylinder outlet tube 454. The spring force pressurizing the quantity of liquid in the piston chamber 428 causes the valve 429 to return to the closed position and prevents any additional liquid from flowing into the interior passage 344 and the piston chamber 328. Because the inlet valve 429 and valve arrangement 82, 84, 86 (shown in FIG. 21D of the previous embodiment) of the spray actuator 390 are closed, liquid pressure in the piston chamber 428, the interior passage 344 and the cylinder outlet tube 354 counteracts the downward force generated by the power spring 472, thereby locking the device 400 in the fully charged configuration.

Once the device 400 is in the fully charged configuration, the user can depress the spray actuator 390 to release fluid spray from the device 400, in the same manner as the previous embodiment. As a result, pressure in the piston chamber 428, the passage 344 and the cylinder outlet tube 454 is released, and the power spring 472 extends and forces the piston and spring driver assembly 430 downward, thereby forcing the piston 340 downward with respect to the piston chamber 428. As piston 340 moves downwardly, the piston 340 forces liquid to flow out of the piston chamber 428, the interior passage 344, and the cylinder outlet tube 454, and then through the nozzle 392 as a liquid spray. The piston and spring driver assembly 430 rotates counterclockwise and moves downward as the teeth 432*a* follow the threads 363. The liquid spray produced by the device 400 remains continuous until the user stops depressing the spray actuator 390 or a maximum possible amount of the liquid in the piston chamber 328, the passage 344 and the cylinder outlet tube 454 has been sprayed out of the nozzle 392. Once the user stops depressing the spray actuator 390, the valve arrangement 82, 84, 86 (FIG. 21D) returns to its closed position, thereby preventing further liquid spray from the device 400. If a maximum possible amount of the liquid in the piston chamber 428, the passage 344 and the cylinder outlet tube 454 is sprayed out of the nozzle 192, the device 400 is returned to its initial configuration shown in FIG. 30 by the force generated by the power spring 472.

As with the previous embodiments, when charging the device 400, a user can stop turning the charger 360 before the device 400 reaches the fully charged configuration shown in FIG. 31, thereby causing the inlet valve 429 to close and locking the device 400 in a partially charged configuration with the piston 340 and power spring 472 locked in their partially charged positions. Once the user stops turning the charger 360 at any position between its initial rotational position of FIG. 30 and its rotational position in the fully charged configuration of FIG. 31, the spray actuator 390 can be depressed to continuously spray liquid from the device 400.

Although the device 400 is shown and described with a piston 340 and power spring 472 in side-by-side arrangement, it should be understood that the device could be reconfigured to arrange the piston and power spring in a concentric arrangement.

As indicated above, the devices 300 and 400 provide a mechanical assist feature (a lead screw arrangement accomplished by threaded engagement between the charger 360 and the piston and plunger assembly 330/piston and spring driver assembly 430) to facilitate charging of the devices. It should be understood that alternative mechanical assist features can be provided instead of the lead screw arrangement. For example, the various devices described above can be reconfigured to employ a lever-actuated ratchet or other mechanical assists.

In the embodiments employing a vacuum chamber and vacuum plunger to generate a source of energy for the fluid spray (FIGS. 10A-19, FIG. 20, and FIGS. 21A-29), the maximum duration of the fluid spray during actuation of the spray actuator is a direct function of a volume of the vacuum in the vacuum chamber. Furthermore, in these embodiments, the spray pressure of the fluid spray is a direct function of a diameter of the plunger head of the vacuum plunger. In the embodiments employing a power spring (FIGS. 1A-9 and FIGS. 30-31), the maximum duration of the fluid spray and the spray pressure of the fluid spray are functions of the change in the length of the spring from its compressed position to its extended position and the spring rate of the power spring. Spray pressure and duration in the disclosed embodiments are also affected by the viscosity of the liquid being sprayed. One skilled in the art would therefore understand how to design the various components (e.g., maximum volume of the vacuum chamber and diameter of the plunger head, or the spring rate and change in the length of the spring from its compressed position to its extended position) of the disclosed spray devices in order to achieve desired spray characteristics for a particular liquid.

It should be apparent that the foregoing describes only selected embodiments of the invention, and numerous changes and modifications may be made to the embodiments disclosed herein by one of ordinary skill in the art without departing from the general spirit and scope of the invention as defined by the following claims and equivalents thereof. For example, it should be understood that the various devices described above can be reconfigured such that charging of the devices is accomplished by pulling a charger instead of pushing a charger, or turning a charger counterclockwise instead of turning a charger clockwise. It should also be understood that the various directions referred to in the foregoing description may change based on the orientation of the devices during use.

We claim:

1. A spray device comprising:

a body defining a reservoir for holding content;

a first chamber in selective communication with the reservoir;

a piston slidably positioned in the first chamber;

a first valve configured to control flow of the content from the reservoir into the first chamber;

a second chamber;

a vacuum plunger slidably positioned in the second chamber;

a charger connected to the piston and the vacuum plunger and operable to displace the piston and the plunger to create a vacuum in the second chamber that imposes a force on the vacuum plunger and the piston, thereby pressurizing a quantity of the content in the first chamber;

a spray nozzle in selective communication with the first chamber;

a second valve configured to control flow of the quantity of the content in the first chamber out of the first chamber to the nozzle; and a spray actuator operable to generate a spray of the content from the nozzle by opening the second valve.

2. The device as in claim 1, wherein the content is a liquid.

3. The device as in claim 1, wherein the charger is manually operable to displace the piston and the plunger and thereby configure the device to generate the spray of the content.

4. The device as in claim 1, wherein the first and second valves are operable to close, thereby retaining the quantity of the content in the first chamber and locking the device in a charged configuration in which the device is configured to generate the spray of the content upon actuation of the spray actuator.

5. The device as in claim 1 wherein the spray actuator is operable to enable the quantity of the content in the first chamber to flow to the nozzle by opening the second valve.

6. The device of claim 1, wherein the charger is operable to cause the first valve to open and thereby allow a portion of the content in the reservoir to enter the first chamber.

7. The device of claim 1, wherein the charger is a substantially hollow, cylindrical member that is reciprocatable with respect to the body.

8. The device of claim 7, wherein the charger is configured to slide over a portion of the body when actuated.

9. The device of claim 1, comprising a base member operatively engaged by the charger to displace the piston and the vacuum plunger.

10. The device of claim 9, wherein:

the charger is a substantially hollow, cylindrical member including threads on an internal surface of the charger;

the base member includes radially-projecting teeth configured to engage the threads; and the charger is operable to rotate with respect to the body such that the base member, the piston and the plunger rotate, causing the piston and the plunger to translate.

11. The device of claim 10, comprising an actuator base supporting the spray actuator, wherein the actuator base includes a cylinder outlet tube received in an interior passage of the piston, wherein the interior passage of the piston is in communication with the first chamber, and wherein the cylinder outlet tube is in communication with the interior passage of the piston and the nozzle.

12. The device of claim 1, wherein the piston and the plunger are positioned side-by-side in the device.

13. The device of claim 1, wherein the piston and the plunger are concentrically positioned with respect to each other in the device.

14. The device of claim 1, wherein the piston includes an interior passage in communication with the first chamber, and wherein the first chamber is in communication with the reservoir through the interior passage.

15. The device of claim 14, wherein the first valve is formed in the piston and is configured to control a flow of the content from the reservoir into the interior passage.

16. The device of claim 1, wherein the vacuum in the second chamber provides a source of energy for the spray of the content.

17. The device of claim 1, wherein the device is configured such that a duration of the spray of the content is a direct function of a volume of the vacuum in the second chamber.

18. The device of claim 1, wherein the device is configured such that a spray pressure of the spray of the content is a direct function of a diameter of a plunger head of the vacuum plunger.

19. A method for spraying content from a spray device, comprising:

actuating a charger of the device to pressurize a quantity of content in a first chamber of the device; and actuating a spray actuator of the device to release a spray of the content from the device;

wherein the device comprises:

a body defining a reservoir for holding the content, the reservoir being in selective communication with the first chamber, a piston slidably positioned in the first chamber, a first valve configured to control flow of the content from the reservoir into the first chamber, a vacuum second chamber, a vacuum plunger slidably positioned in the second chamber and, a spray nozzle in selective communication with the first chamber, and a second valve configured to control flow of the quantity of the content in the first chamber out of the first chamber to the nozzle;

wherein the charger is connected to the piston and the plunger, and is operable to pressurize the quantity of the content in the first chamber by displacing the piston and the plunger to create a vacuum in the second chamber that impose a force on the vacuum plunger and the piston; and wherein the spray actuator is operable to generate the spray of the content from the nozzle by opening the second valve.

20. The method of claim 19, wherein the content is liquid.

21. A spray device comprising:

a body defining a reservoir for holding content;

a first chamber in selective communication with the reservoir;

a piston slidably positioned in the first chamber;

a first valve configured to control flow of the content from the reservoir into the first chamber;

a second chamber;

a vacuum plunger slidably positioned in the second chamber;

a charger operably connected to the piston and the vacuum plunger and operable to displace the piston and the plunger to create a vacuum in the second chamber that imposes a force on the vacuum plunger and the piston, thereby pressurizing a quantity of the content in the first chamber; and a spray assembly in communication with the first chamber and configured to selectively dispense content from the spray device.

22. A spray device comprising:

a body defining a reservoir for holding content;

a first chamber in selective communication with the reservoir;

a piston slidably positioned in the first chamber;

a first valve configured to control flow of the content from the reservoir into the first chamber;

a second chamber;

a vacuum plunger slidably positioned in the second chamber;

a charger operably connected to the piston and the vacuum plunger and operable to displace the piston and the plunger to create a vacuum in the second chamber; and a spray assembly in communication with the first chamber and configured to selectively dispense the content from the spray device, wherein, when the spray assembly is operated to dispense the content from the spray device, the vacuum applies a force to the piston through the vacuum plunger to urge the content in the first chamber out of the first chamber and through the spray assembly.

* * * * *